United States Patent [19]

Sakuma et al.

[11] Patent Number: 4,614,230

[45] Date of Patent: Sep. 30, 1986

[54] HEAT EXCHANGER

[75] Inventors: Kiyoshi Sakuma, Fujieda; Tetsuji Okada, Shizuoka; Yu Seshimo, Fujisawa; Kazuhiro Maruyama; Kisuke Yamazaki, both of Kamakura; Yuichi Akiyama, Tokyo, all of Japan

[73] Assignee: Mitsubishi Denki Kabushiki Kaisha, Tokyo, Japan

[21] Appl. No.: 582,708

[22] Filed: Feb. 23, 1984

[30] Foreign Application Priority Data

Jul. 29, 1983 [JP] Japan ..... 58-138904

[51] Int. Cl.[4] ..... F28D 1/04

[52] U.S. Cl. ..... 165/151; 165/181

[58] Field of Search ..... 165/151, 152, 153, 181

[56] References Cited

U.S. PATENT DOCUMENTS

| | | | |
|---|---|---|---|
| 3,265,127 | 8/1966 | Nickol et al. | 165/152 |
| 3,397,741 | 8/1968 | Gunter | 165/152 |
| 3,796,258 | 3/1974 | Malhorta et al. | 165/151 |
| 4,300,629 | 11/1981 | Hatada et al. | 165/151 |
| 4,365,667 | 12/1982 | Hatada et al. | 165/152 |
| 4,434,844 | 3/1984 | Sakitani et al. | 165/151 |
| 4,469,167 | 9/1984 | Itoh et al. | 165/151 |

FOREIGN PATENT DOCUMENTS

| | | | |
|---|---|---|---|
| 2532409 | 3/1984 | France | 165/152 |

OTHER PUBLICATIONS

German Abstract, GM 8126745, Feb. 25, 1982.

*Primary Examiner*—Albert W. Davis, Jr.
*Assistant Examiner*—Peggy A. Neils
*Attorney, Agent, or Firm*—Oblon, Fisher, Spivak, McClelland & Maier

[57] ABSTRACT

A plate-fin-tube type heat exchanger is constructed with a multitude of plate fins juxtaposed one another and a plurality of heat transmitting tubes passing through said plate fins and being held thereby. A plurality of cut and raised pieces are formed to intersect orthogonally with the air flowing direction at both front and rear surfaces of said plate fins with a certain space interval among them in the air flowing direction and at a location between the adjacent heat transmitting tubes arranged in the longitudinal direction of said plate fins, and then the edge portion on both sides of each cut and raised piece is re-bent in the direction opposite to the lifting direction of said piece and in substantially parallel with the surface of said plate fin so that the cross-section of said cut and raised piece may assume a sloping form in the direction of the air flow and that fin base plate portion may be present between the adjacent cut and raised pieces in parallel with the air flow.

15 Claims, 33 Drawing Figures

FIGURE 1 *PRIOR ART*
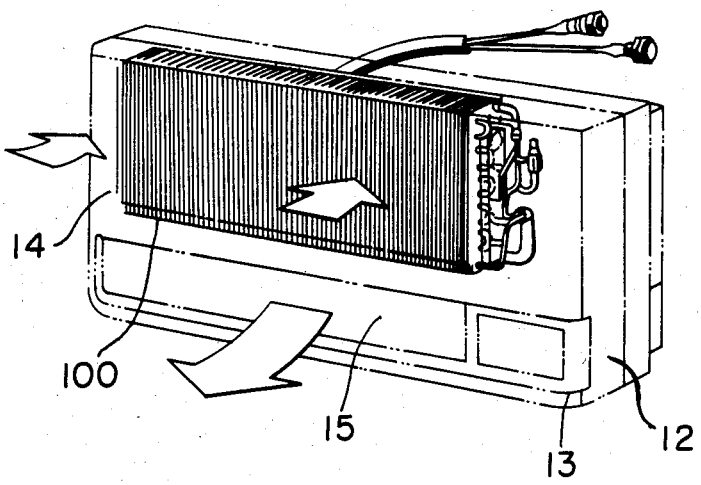
FIGURE 2 *PRIOR ART*
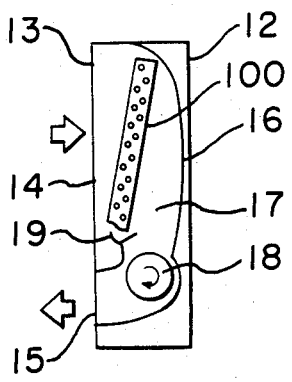

FIGURE 3 *PRIOR ART*
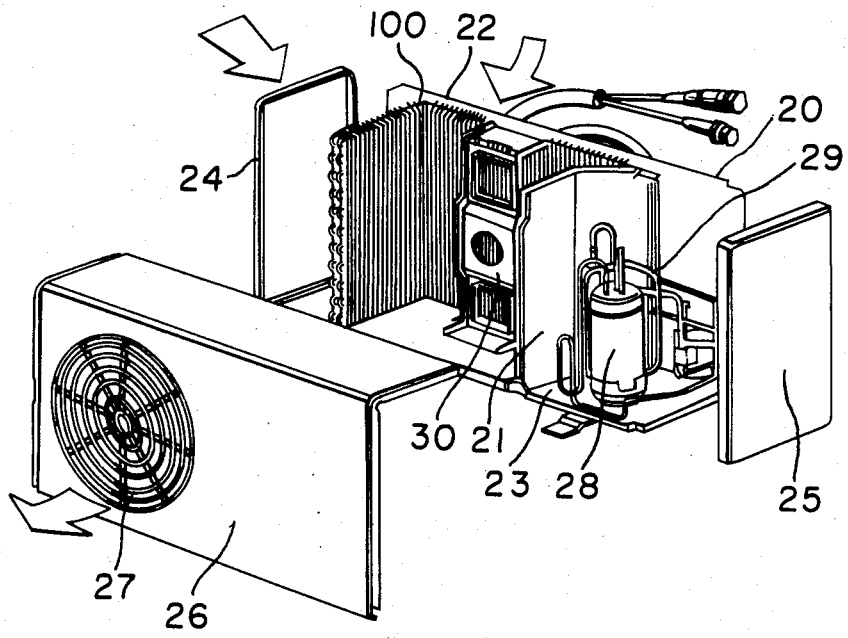
FIGURE 4 *PRIOR ART*
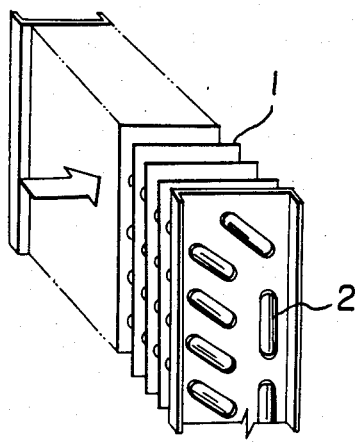

FIGURE 5 *PRIOR ART*
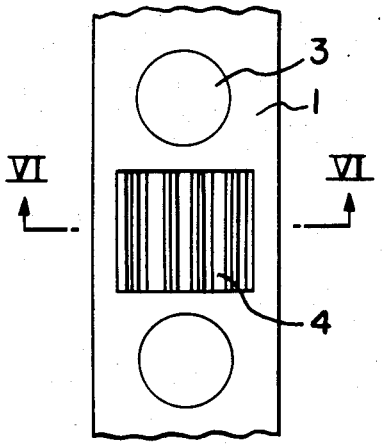
FIGURE 6 *PRIOR ART*
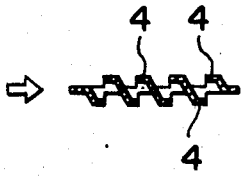

HEAT EXCHANGER

BACKGROUND OF THE INVENTION

The present invention relates to an air conditioner, a refrigerator, and so forth, and, more particularly, it is concerned with improvement in a plate-fin-tube type heat exchanging device to be used for these apparatuses.

In general, the plate-fin-tube type heat exchanging device is of such a construction that a plurality of heat transmission tubes are passed through a plurality of juxtaposed plate fins in the direction perpendicular to these plate fins, and the heat transmission tubes are held in close contact with the fins by tube expansion, or various other expedients. The primary fluid such as cool or warm water, refrigerant, or the like is caused to pass through these heat transmission tubes, while the secondary fluid such as air, etc. is caused to pass through the space among these fins, thereby effecting the heat exchange between these two fluids.

Incidentally, there tends to be readily formed a boundary layer of flow in the air stream flowing along and through these fins. The temperature gradient in this boundary layer is so large that this layer portion constitutes enormous heat resistance. Further, this boundary layer grows up thick in the flowing direction of the secondary fluid, on account of which the heat transfer rate of the fins is considerably lowered at the downstream part of the fins in the fluid flowing direction.

Thus, with the plate-fin tube type heat exchanger, the most significant problem is the low heat transfer rate at the side of the secondary fluid (the fin side). In order therefore to improve this heat transfer rate at the fin side, it is necessary to effectively prevent the above-mentioned boundary layer from forming and growing up, for which purpose there have so far been made various proposals concerning the shape of the fins to be worked on the surface of the plate fin.

In the following, explanations will be made as to a conventional example of the plate-fin-tube type heat exchanger when it is assembled in an air conditioning apparatus, in reference to FIGS. 1 and 2 of the accompanying drawing which are respectively a perspective view showing a construction of a room unit of a separate type air conditioning apparatus and a schematic cross-sectional view of the room unit of such separate type air conditioning apparatus.

In the drawing, a reference numeral 12 designates a main body of the air conditioner; a numeral 13 refers to a front panel to cover the front face of the main body of the air conditioner, having an intake grill 14 and an air outlet 15 formed therein; a reference numeral 16 denotes a casing which forms an air course 17 to communicatively connect the intake grill 14 and the air outlet 15 within the main body 12; a numeral 18 refers to an air blower installed at the side of the air outlet 15 of the air course; and a reference numeral 100 designates the plate-fin-tube type heat exchanger installed at the side of the intake grill 14 in the air course 17 and having a drain pan 19 provided underside of it.

In the illustrated air conditioning apparatus, the air flows in the direction as shown with arrow marks. That is to say, with rotation of the air blower 18, the air flows into the plate-fin-tube type heat exchanger 100, the heat exchanging characteristic of which is largely governed by the quantity of this air flow taken into the heat exchanger.

FIG. 3 of the accompanying drawing is an exploded perspective view showing a construction of an outside unit of the separate type air conditioning apparatus. In the drawing, a reference numeral 20 designates a main body of the outside unit; a reference numeral 21 indicates a partition plate to divide the main body 20 into a heat exchanger room 22 and a compressor room 23; numerals 24 and 25 refer to a left side plate and a right side plate of the main body 20, respectively; a reference numeral 26 represents a cover plate in an inverted L-shape for covering the top and front faces of the main body 20 and having an air outlet formed in the front side (incidentally, the air inlets (not shown in the drawing) being formed in the left side plate 24 and the back side of the main body 20); a reference numeral 28 designates a compressor installed in the compressor room 23. An L-shaped, plate-fin-tube type heat exchanger 100 is disposed in confrontation to the above-mentioned left side plate 24 and the back side of the main body 20, and is communicatively connected with the compressor 28 by means of a tube 29. A numeral 30 refers to a bracket for attaching an air blower (not shown) thereto in the direction of the air outlet 27.

In the illustrated air conditioning apparatus, the air flows in the direction as shown with arrow marks. That is to say, with rotation of the air blower (not shown), the air flows into the plate-fin-tube type heat exchanger 100 through the air inlets (not shown) and is discharged from the air outlet 27. The heat exchanging characteristic of this heat exchanger is largely governed by the quantity of the air taken into this heat exchanger.

FIGS. 4, 5 and 6 of the accompanying drawing illustrate one example of a conventional plate-fin-tube type heat exchanger to be incorporated in an air conditioning apparatus of a general type, which is disclosed in unexamined Japanese utility model publication No. 144988/1981. As shown in FIG. 4, the plate-fin-tube type heat exchanger is constructed with a plurality of fins 1 arranged in parallel with one another at a certain definite space interval among them and a plurality of heat transmission tubes 2 passed through these fins at the right angle. Air flows through the space among these fins 1 in the arrow direction, during which the heat exchange is effected between the air current and the fluid in the heat transmission tubes 2.

FIG. 5 is a front view of the conventional plate-fin-tube type heat exchanger, and FIG. 6 is a cross-sectional view of the heat exchanger taken along a line VI—VI in FIG. 5. As seen from the drawing, a plurality of incisions or cuts are made in the planar fin base plate 1 having a plurality of holes 3 formed therein for passing the heat transmission tubes (not shown) therethrough. The incisions are made at a space in the plate fin between the adjacent tube inserting holes 3 arranged in the longitudinal direction of the fins, through which the heat transmission tubes (not shown) are passed, and in the direction orthogonally intersecting with the flowing direction of the fluid passing through the space intervals among the fin base plates 1. Then, the incised portions are jerked up toward both front and rear surfaces of the fin base plate 1 followed by bending both edges inwardly toward the surface of the fin base plate in a parallel relationship therewith, thereby forming a plurality of cut and raised pieces 4 or louvers arranged in a certain definite direction and in parallel with the longitudinal direction of the fin base plate 1.

The purpose of the proposal in this prior art is to improve the heat transmission characteristic in the known heat exchanger. However, with such construction of the fins as mentioned above, a temperature field of the boundary layer to be formed by the cut and raised pieces 4 at the upstream side of the air flow (shown in the arrow mark) gives influence on the cut and raised pieces 4 at the downstream side of the air flow, which brings about various disadvantages such that the leading edge effect of these cut and raised pieces at the downstream side cannot be fully made use of; the heat transfer rate is conversely low, the wind pressure loss increases; and the drive power for air blowing becomes large, and others. There is also a problem from the aspect of working of the fin such that, since the cut and raised pieces are all formed in one and the same direction with respect to the fin base plate, distortion would occur in the fin base plate as a whole during the working of the fins.

SUMMARY OF THE INVENTION

The present invention has been made to remove the above-described disadvantages inherent in the conventional heat exchanging apparatus, and aims at providing an improved heat exchanging apparatus which has large heat transfer rate and small wind pressure loss.

According to the present invention in one aspect of it, there is provided a plate-fin-tube type heat exchanger constructed with a multitude of plate fins juxtaposed one another and a plurality of heat transmission tubes passing through the plate fins and being held thereby, the heat exchanging operations being effected between a refrigerant flowing in the heat transmission tubes and air passing through the space intervals among the plate fins, characterized in that a plurality of cut and raised pieces or louvers orthogonally intersecting with the air flowing direction are formed at both front and rear surfaces of the plate fins with a certain space interval among them in the air flowing direction and at a location between the adjacent heat transmission tubes arranged in the longitudinal direction of the plate fins, and then the edge of each cut and raised piece on both sides thereof is re-bent in the direction opposite to the lifting direction of the piece and in substantially parallel with the surface of the plate fin so that the cross-section of the cut and raised piece may assume a sloping (⟍) form in the direction of the air flow and that fin base plate portion may be present between the adjacent cut and raised pieces in parallel with the air flow.

According to the present invention in another aspect of it, there is provided a plate-fin-tube type heat exchanger constructed with a multitude of plate fins juxtaposed one another and a plurality of heat transmission tubes passing through the plate fins and being supported thereby, the heat exchanging operations being effected between a refrigerant flowing in the heat transmission tubes and air passing through the space intervals among the plate fins, characterized in that a plurality of cut and raised pieces orthogonally intersecting with the air flowing direction are formed at both front and rear surfaces of the plate fins with a certain space interval among them in the air flowing direction and at a location between the adjacent heat transmission tubes arranged in the longitudinal direction of the plate fins, and then the edge of each cut and raised piece on both sides thereof is re-bent in the direction opposite to the lifting direction of the piece and in substantially parallel with the surface of the plate fin so that the cross-section of the cut and raised piece may assume a sloping (⟍) form in the direction of the air flow and that a fin base plate portion between the adjacent cut and raised pieces may be further inclined with respect to the fin base plate.

According to the present invention in still another aspect of it, there is provided a plate-fin-tube type heat exchanger constructed with a multitude of plate fins juxtaposed one another and a plurality of heat transmission tubes passing through the plate fins and being supported thereby, the heat exchanging operations being effected between a refrigerant flowing in the heat transmission tubes and air passing through the space intervals among the plate fins, characterized in that a plurality of cut and raised pieces orthogonally intersecting with the air flowing direction are formed at both front and rear surfaces of the plate fins with a certain definite space interval among them in the air flowing direction and in one and the same direction with respect to the fin base plate, and at a location between the adjacent heat transmission tubes arranged in the longitudinal direction of the plate fins, and then the edge of each cut and raised piece on both sides thereof is re-bent in the direction opposite to the lifting direction of the piece and in substantially parallel with the surface of the plate fin so that the cross-section of the cut and raised piece may assume a step form in the direction of the air flow and that a fin base plate portion may be present between the adjacent cut and raised pieces in parallel with the air flow.

According to the present invention in other aspect of it, there is provided a plate-fin-tube type heat exchanger constructed with a multitude of plate fins juxtaposed one another and a plurality of heat transmission tubes passing through the plate fins and being supported thereby, the heat exchanging operations being effected between a refrigerant flowing in the heat transmisison tubes and air passing through the space intervals among the plate fins, characterized in that a plurality of cut and raised pieces orthogonally intersecting with the air flowing direction are formed at both front and rear surfaces of the plate fins with a certain definite space interval among them in the air flowing direction and in one and the same direction with respect to the fin base plate, and at a location between the adjacent heat transmission tubes arranged in the longitudinal direction of the plate fins, and then the edge of the each cut and raised piece on both sides thereof is re-bent in the direction opposite to the lifting direction of the piece and in substantially parallel with the surface of the plate fin so that the cross-section of the cut and raised piece may assume a step form in the direction of the air flow and that the the leading edge effect of the boundary layer which promotes the heat transfer effect, whereby the heat transfer performance of the heat exchanger decreases. On the other hand, when the total length F′ in the flowing direction of the air current of the cut and raised piece 9 in the step form is long, the lifting height E′ of the piece is restricted by the space interval between the adjacent plate fins and the angle of inclination $\theta'$ for lifting the piece becomes small, on account of which the repetitive effect of the air running sections in the sinuous flow paths, which promotes the heat transfer effect, cannot be fully taken advantage of, and the heat transfer performance of the heat exchanger decreases.

In the following, explanations will be made as to the function of the heat exchanger, when a relational equation $F'/(A'/NR')$ is set to be in a range of from 0.15 to 0.4, where A′ is the total length of the plate fin in the flow path direction of the air current, NR′ denotes the number of rows of the group of heat transmission tubes passing in the direction orthogonal to the air current (when such group of heat transmission tubes is called 'row'), and F′ represents a length in the flowing direction of the air current of the cut and raised piece 9 in the step form. As has already been mentioned in the foregoing, since the cut and raised pieces 9 in the step form are provided, the cut and raised pieces in the mutually adjacent plate fins form a sinuous flow path, and, owing to the repetitive effect of the running sections for the air current, the temperature boundary present between the adjacent cut and raised pieces in parallel with the air flow.

According to the present invention in further aspect of it, there is provided a plate-fin-tube type heat exchanger constructed with a multitude of plate fins juxtaposed one another and a plurality of heat transmission tubes passing through the plate fins and being supported thereby, the heat exchanging operations being effected between a refrigerant flowing in the heat transmission tubes and air passing through the space intervals among the plate fins, characterized in that a plurality of cut and raised pieces orthogonally intersecting with the air flowing direction are formed in the plate fins at a location between the mutually adjacent heat transmission tubes arranged in the longitudinal direction of the plate fins in such a manner that the adjacent cut and raised pieces formed at both front and rear surfaces of the plate fins with a certain definite space interval among them in the air flowing direction may be in a mutually opposite direction with respect to the fin base plate, and then the edges of the each cut and raised piece on both sides thereof is re-bent in the direction opposite to the lifting direction of the piece and in substantially parallel with the surface of the plate fin so that the cross-section of the cut and raised piece may assume a step form in the direction of the air flow and that the fin base plate portion between the adjacent cut and raised pieces may further be made a substantially inverted V-shape.

BRIEF DESCRIPTION OF THE DRAWINGS

The foregoing objects, other objects as well as the specific construction and function of the heat exchanging device according to the present invention will become more apparent and understandable from the following detailed description thereof, when read in conjunction with the accompanying drawing.

In the drawing

FIG. 1 is a perspective view showing a construction of a room unit of a separate type air conditioning apparatus;

FIG. 2 is a schematic cross-sectional view of the room unit of the separate type air conditioning apparatus shown in FIG. 1;

FIG. 3 is an exploded perspective view showing a construction of an outside unit of the separate type air conditioning apparatus;

FIG. 4 is a perspective view showing a conventional plate-fin-tube type heat exchanging device;

FIG. 5 is a front view of the plate-fin-tube type heat exchanger;

FIG. 6 is a cross-sectional view taken along a line VI—VI in FIG. 5;

DETAILED DESCRIPTION OF THE PREFERRED EMBODIMENTS

In the following, the present invention will be described in detail with reference to several preferred embodiments thereof shown in the accompanying drawing.

Figure 7:
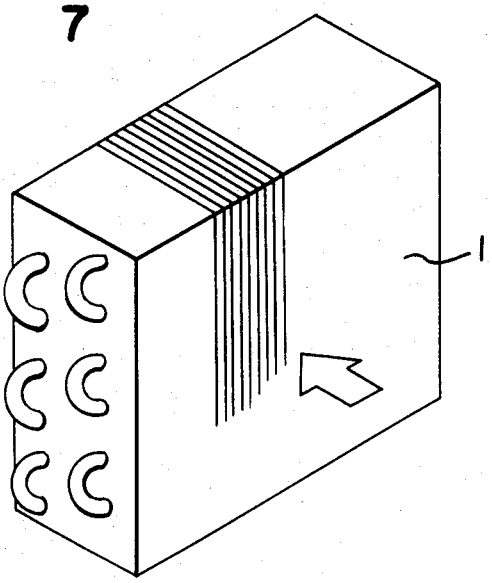
FIG. 7 is a schematic perspective view showing the plate-fin-tube type heat exchanger according to the present invention.
Figure 8:
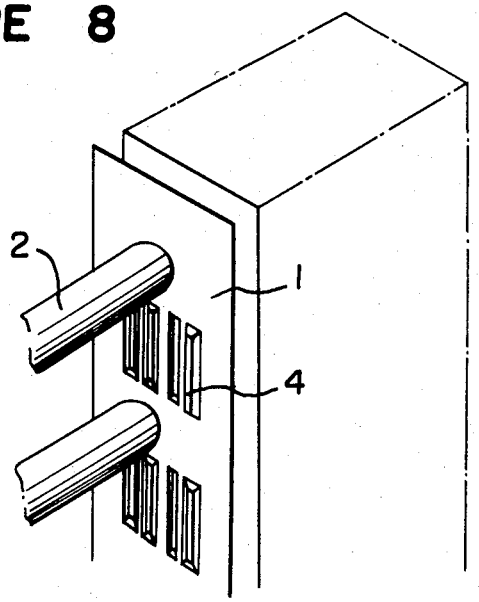
FIG. 8 is a partially enlarged perspective view of the heat exchanger shown in FIG. 7.
Figure 9:
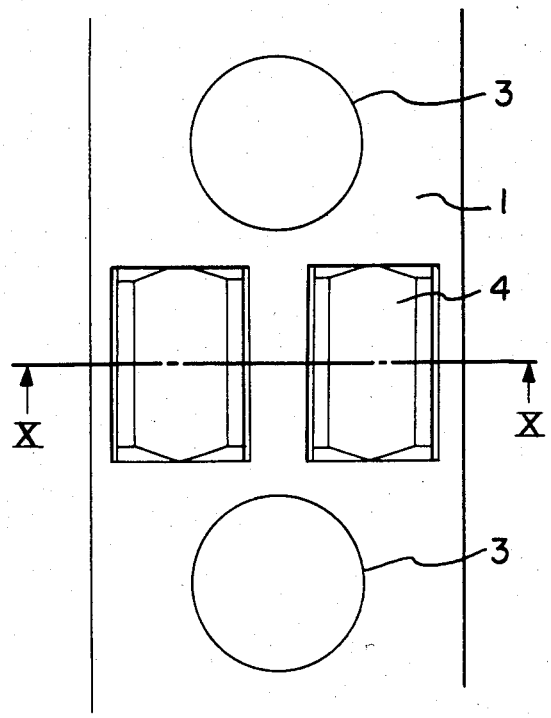
FIG. 9 is a front view, in part, showing the first embodiment of the plate fins to be used for the heat exchanger shown in FIGS. 7 and 8.
Figure 10:
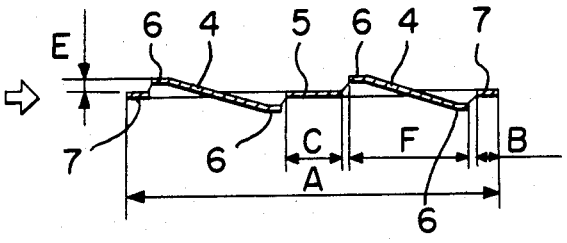
FIG. 10 is a cross-sectional view taken along a line X—X in FIG. 9.
Figure 11:
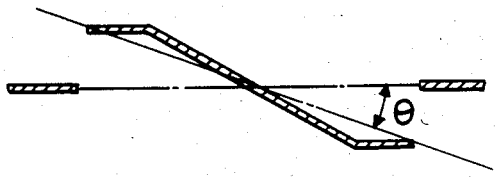
FIG. 11 is an enlarged cross-sectional view of the main part of the plate fin showing an apparent angle of inclination $\theta$ of the cut and raised piece in the sloping form with respect to the fin base plate.

Referring to the drawing, FIG. 7 is a schematic perspective view showing one embodiment of the plate-fin-tube type heat exchanger according to the present invention; FIG. 8 is an enlarged perspective view, in part, of the heat exchanger shown in FIG. 7; FIG. 9 is a front view, in part, showing the first embodiment of the plate fin shown in FIG. 8; and FIG. 10 is a cross-sectional view taken along a line X—X in FIG. 9. As seen from FIGS. 7 and 8, the plate-fin-tube type heat exchanger is constructed with a plurality of fin base plates 1 arranged in parallel one another with a certain definite space interval among them and a plurality of heat transmission tubes 2 being inserted in, and passing through, these fin base plates 1 at the right angle thereto. The current of air flows through the spaces among the fin base plates 1 in the direction as shown by an arrow mark. Details of the fin base plate 1 are shown in FIGS. 9 through 11. That is to say, FIG. 9 illustrates the fin base plate 1 of the plate fin having a total length A in the flow path direction of the air current. The fin base plate 1 also has a plurality of holes 3 to permit a plurality of heat transmission tubes to pass therethrough. A reference numeral 4 designates cut and raised pieces or louvers formed in a space between the mutually adjacent insertion holes 3 for the heat transmission tubes, each piece having a total length F in the direction of the air flow. Each cut and raised piece is so formed that required numbers of parallel cuts or incisions are made in the abovementioned fin base plate 1 in its longitudinal direction with a planar fin base plate portion 5 having a length C in the flowing direction of the air current as a separating boundary, then these cuts are jerked outward over the front and rear surfaces of the fin base plate 1 on the march of the plane of the fin base plate 1 at a certain definite angle of inclination $\theta$ and in a certain definite direction as shown in FIG. 11 and with a lifting height E, and thereafter the edge portions 6 on both sides of the cut and raised piece are bent again in the direction opposite to its lifting direction in a manner to be substantially parallel with the surface of the fin base plate 1 so that the cross-sectional shape of the cut and raised piece may assume a sloping form (⌝) with respect to the flowing direction of the air current (as shown by an arrow mark) in FIG. 10. In addition to the fin base plate portion 5, there are also arranged fin base plate end portions 7 at both upstream and downstream sides in the flowing direction of the air current, each having a length B and extending from the end part of the fin to the edge of the cut and raised piece 4 in the sloping form. The dimensional relationship among these parts constituting the cut and raised pieces and the fin base plate portion are in the range to be mentioned as follows. That is, the total length F in the flowing direction of the air current of the cut and raised piece 4 in the sloping form is set to be in a value ranging from 4.0 to 6.0 mm; a relational equation of F/(A/NR) among the total length F in the flowing direction of the air current of the cut and raised piece 4 in the sloping form, the total length A of the plate fin in the flow path direction of the air current, and the number of row NR of a group of heat transmission tubes passing in the direction orthogonal to the air current (when such group of heat transmission tubes is called 'row') is in a range of from 0.15 to 0.4; the lifting height E of the cut and raised piece 4 in the sloping form is in a range of from 0.7 to 0.9 mm; the length C of the fin base plate portion 5 positioned intermediate the adjacent cut and raised pieces 4 in the sloping form is in a range of from 1.5 to 4.0 mm; and a ratio C/F between the length C of the fin base plate portion 5 and the length F in the air flowing direction of the cut and raised piece 4 in the sloping form is in a range of from 0.4 to 0.8. Further, the length B of the fin base plate edge portions 7, 7 positioned at both upstream and downstream sides with respect to the air flowing direction, each extending from the end part of the fin to the edge of the cut and raised piece 4 in the sloping form, is in a range of from 1.5 to 4.0 mm.

Explaining the function of the thus constructed plate-fin-tube type heat exchanger, since the cut and raised pieces 4 are in the sloping form, when a multitude of plate fins are arranged in juxtaposition to one another to construct the heat exchanger as shown in FIGS. 7 and 8, there will be formed a plurality of sinuous flow paths among the cut and raised pieces 4 in one plate fin and those in the juxtaposed plate fins. The air current passing through these sinuous slow paths performs the direction changing in a plurality of numbers of times, and the overall boundary layer becomes thinner due to repetitive effect to be derived from the flat running sections, whereby the heat transfer rate improves. In addition, presence of the fin base plate portion 5 between the adjacent cut and raised pieces 4 prolongs the distance between these adjacent cut and raised pieces 4, on account of which the boundary layer which is liable to give influence on the leading edge part of the cut and raised piece is substantially removed, unlike the conventional heat exchanger, and the leading edge effect of the cut and raised piece 4 at the downstream side of the air flow can be sufficiently taken advantage of, whereby a high heat transfer rate can be obtained. Further, unlike the conventional heat exchanger, there is no possibility of the leading effect of the cut and raised pieces 4 in the juxtaposed and mutually adjacent plate fins being hindered by the influence of the boundary layer.

The leading edge parts of the cut and raised pieces 4 and the fin base plate portion 5 are all arranged in a staggered form with respect to the flowing direction of the air current, and, in addition, the cut and raised piece 4 and the fin base plate portion 5 at the downstream side are so arranged that the growing direction of the boundary layer may not be present in one and the same plane, hence, even when the growing direction becomes identical, the distance between them is sufficient to remove the boundary layer at the leading edge part to a substantial extent so as not to give influence on the leading edge effect at that part. Moreover, since the structure of the plate fins is not inconvenient as to create parting or turbulence of the air flow, which brings about decrease in the heat transmission characteristic and increase in the wind pressure loss, so that the air flow can be kept smooth.

Incidentally, since the abovementioned cut and raised piece 4 has its edge parts 6, 6 at both sides thereof rebent in the direction opposite to their lifting, the fin can get sufficient mechanical strength. Moreover, since the adjacent cut and raised pieces 4, 4 are amply spaced apart each other in comparison with the conventional heat exchanger, the strength of the plate fin can also be increased.

Figure 12:
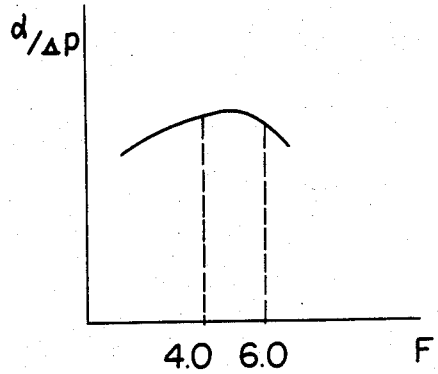
FIG. 12 is a graphical representation showing a characteristic curve concerning the total length F in the direction of the air flow of the cut and raised piece shown in FIG. 10.

In the following, the function of the plate fin will be explained, when the total length of the cut and raised piece 4 in the sloping form in the flowing direction of the air current is designated F, and its value is taken in a range of from 4.0 to 6.0 mm. As has already been mentioned, since the cut and raised pieces 4 in the sloping form are provided, there are formed sinuous air flow path with the cut and raised portions 4, 4 in the mutually adjacent plate fins, and, owing to the repetitive effect of the running sections for the air flow, the temperature boundary layer becomes extinct to remarkably improve the heat transmission performance. It will be seen here that, when the total length F in the flowing direction of the air current of the cut and raised piece 4 in the sloping shape is set to be in a range of from 4.0 to 6.0 mm, a ratio $\alpha/\Delta P$ between a heat transfer rate $\alpha$ outside the tube and a wind pressure loss $\Delta P$, which is one of the important factors for determining the performance of the heat exchanger, becomes the maximum as shown in FIG. 12.

The reason for this is considered as follows. When the total length F of the cut and raised piece 4 in the sloping shape in the flowing direction of the air current is short, the angle of inclination $\theta$ of the piece should be made large in order to maintain constant the lifting height E of the piece with the consequence that parting of the air current takes place at the downstream of the edge parts on both sides of the cut and raised piece 4 in the sloping shape to lower the heat transfer performance; on the contrary, when the angle of inclination $\theta$ of the piece is kept constant, the lifting height E becomes low and the cut and raised piece 4 comes into the thickness of the temperature boundary layer to be formed in the inflow direction of the air current to make it unable to fully utilize the leading edge effect of the boundary layer which produces the heat transfer promotion effect, whereby the heat transfer performance of the heat exchanger decreases. On the other hand, when the total length F of the cut and raised piece 4 in the flowing direction of the air current in the sloping shape is long, the lifting height E of the piece is restricted by the space interval between the adjacent plate fins and the angle of inclination $\theta$ for the lifting becomes small, on account of which the repetitive effect among the running sections for the air current in the sinuous flow paths, which produces the heat transfer promotion effect, cannot be fully taken advantage of, and the heat transfer performance of the heat exchanger decreases.

In the following, explanations will be made as to the function of the heat exchanger, when a relational equation of F/(A/NR) is in a range of from 0.15 to 0.4, where A is the total length of the plate fin in the flow path direction of the air current, NR denotes the number of rows of the group of heat transfer tubes passing in the direction orthogonal to the air current (when such group of tubes is called a 'row'), and F represents a length of the cut and raised piece 4 in the sloping shape in the direction of the air current flow. As already mentioned, since the cut and raised pieces 4 in the sloping shape are provided, the cut and raised pieces in the mutually adjacent plate fins form sinuous flow paths, and, owing to the repetitive effect of the running sections for the air flow, the temperature boundary layer dies out to remarkably improve the heat transfer performance of the heat exchanger.

Figure 13:
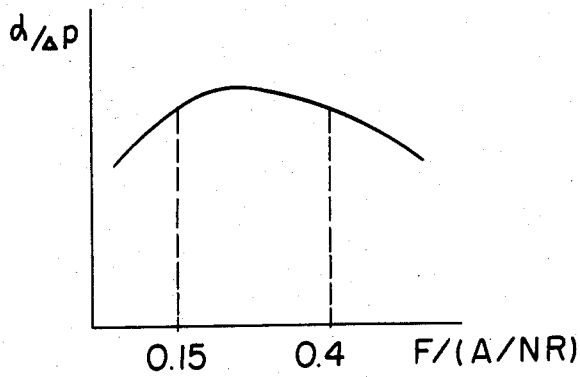
FIG. 13 is a graphical representation showing a characteristic curve concerning a relational equation F/(A/NR) among the total length F in the direction of the air flow of the cut and raised piece, the total length A in the flow path direction of the air current of the fin base plate, and the number of rows NR of a group of heat transmission tubes, as shown in FIG. 10.

When a relational equation of F/(A/NR) is set to be in a range of from 0.15 to 0.4, where A denotes the total length of the plate fin in the flow path direction of the air current, NR indicates the number of rows of the group of heat transfer tubes passing in the direction orthogonal to the air current (when the tube group is called a 'row'), and F is a length of the cut and raised piece 4 in the sloping shape in the flowing direction of the air current, it will be seen that a ratio $\alpha/\Delta P$ between a heat transfer rate $\alpha$ outside the tube and a wind pressure loss $\Delta P$, which is one of the important factors for determining the performance of the heat exchanger, becomes the maximum in this range as shown in FIG. 13.

The reason for this is considered as follows. That is to say, when the total length F of the cut and raised piece 4 in the sloping shape in the flowing direction of the air current becomes shorter than a length A/NR of the fin per row of the heat transfer tubes in the flow path direction of the air current, a ratio of the cut and raised pieces to occupy the overall plate fin becomes low with the consequence that a degree of improvement in the heat transfer performance due to their lifting effect tends to be small. On the other hand, when the total length F of the cut and raised piece 4 in the sloping shape in the flowing direction of the air current becomes longer than the length A/NR of the fin per row of the heat transfer tubes in the flow path direction of the air current, the temperature field of the boundary layer to be formed by the cut and raised pieces at the upstream side with respect to the flow of air current, out of the mutually adjacent cut and raised pieces, would inevitably give influence on the cut and raised pieces 4 at the downstream side, as seen in the aforedescribed conventional heat exchanger, with the consequence that the leading edge effect of the cut and raised piece 4 at the downstream side cannot be fully taken advantage of; the heat transfer rate becomes conversely low; and, further, the wind pressure loss increases to invite augmentation in the air blowing power and noises, hence the heat transfer performance becomes unable to be fully made use of.

Figure 14:
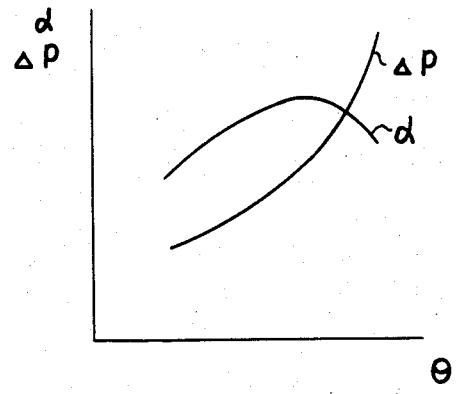
FIGS. 14 and 15 are respectively graphical representations showing a characteristic curve concerning an apparent angle of inclination $\theta$ of the cut and raised piece shown in FIG. 10.
Figure 15:
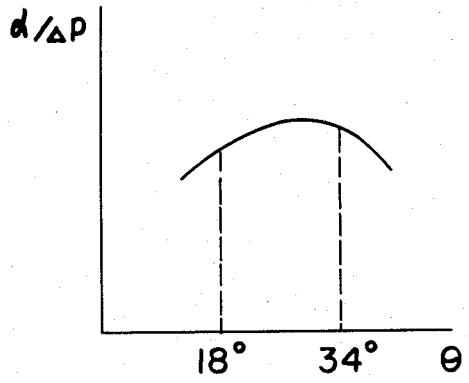

In the following, explanations will be given as to the function of the heat exchanger, when an apparent angle of inclination $\theta$ of the cut and raised piece 4 in the sloping shape, which is an acute angle formed by a rectilinear line connecting the edge parts 6 at both sides of the cut and raised piece 4 in the sloping shape and the fin base plate 1, is in a range of from 18° to 34°, as shown in FIG. 11. As has already been mentioned, since the cut and raised pieces 4 in the sloping shape are provided, the cut and raised part in the mutually adjacent plate fins form a sinuous flow path, and, owing to the repetitive effect of the running sections for the air flow, the temperature boundary layer becomes extinct to remarkably improve the heat transfer performance of the heat exchanger. And, here, when the apparent angle of inclination $\theta$ of the cut and raised piece 4 in the sloping shape is set to be in the range of from 18° to 34°, the heat transfer rate $\alpha$ outside the tube and the wind pressure loss $\Delta P$, which are the important factors for determining the performance of the heat exchanger, vary as shown in FIG. 14 at the same wind velocity. That is to say, the ratio $\alpha/\Delta P$ between the heat transfer rate $\alpha$ outside tubes and the wind pressure loss $\Delta P$ varies as shown in FIG. 15, from which it is seen that the maximum ratio is attained with the apparent angle of inclination $\theta$ of the cut and raised piece 4 in the sloping shape ranging from 18° to 34°.

The reason for this is considered as follows. That is to say, when the apparent angle of inclination $\theta$ of the cut and raised piece in the sloping shape is small, the cut and raised piece 4 in the sloping shape is included in the thickness of the temperature boundary layer to be formed in the inflow direction of the air current to make it unable to take full advantage of the effect to be derived from the cut and raised piece, whereby the heat transmission characteristic becomes reduced. On the other hand, when the apparent angle of inclination $\theta$ of the cut and raised piece 4 in the sloping shape is large, there take place parting of the air current at the downstream side of the sinuous flow path and increase in the wind pressure loss, whereby the heat exchanger lowers its characteristics.

In the following, explanations will be given as to the function of the heat exchanger, when the lifting height E of the cut and raised piece 4 in the sloping form is set to be in a range of from 0.7 to 0.9 mm. As has so far been mentioned, when restrictions are imposed on the total length of the cut and raised piece 4 in the sloping shape in the flowing direction of the air current and on the apparent angle of inclination $\theta$ of the cut and raised piece 4 in the sloping shape, the lifting height E of the cut and raised piece 4 in the sloping shape is determined naturally. However, the lifting height E of the cut and raised piece 4 in the sloping shape according to the present invention is extremely important in conjunction with the relationship among the juxtaposed plate fins, which can be said to be a peculiar effect with the cut and raised piece 4 in the sloping shape.

In the next place, explanations will be made as to the function of the heat exchanger, when the length of the fin base plate portion 5 in the flowing direction of the air current positioned between the mutually adjacent cut and raised pieces in the sloping form is in a range of from 1.5 to 4.0 mm, and a ratio C/F between the length C of the fin base plate portion 5 in the flowing direction of the air current and the length F of the cut and raised piece 4 in the sloping shape in the flowing direction of the air current is made in a range of from 0.4 to 0.8. As has already been mentioned, since the cut and raised pieces 4 in the sloping shape are provided, these cut and raised pieces in the adjacent plate fins form sinuous flow paths for the air current, and, owing to the repetitive effect of the running sections for the air current, the temperature boundary layer becomes extinct to remarkably improve the heat transfer performance of the heat exchanger. However, as seen in the conventional heat exchanger, if the adjacent cut and raised pieces 4 in the sloping shape are too close, the cut and raised pieces 4 in the sloping shape at the downstream side in the flowing direction of the air current are influenced by the temperature field of the boundary layer to be formed by the cut and raise pieces 4 at the upstream side with respect to the air current (as shown by an arrow mark), out of the respective cut and raised pieces 4. As the consequence of this, the leading edge effect of this cut and raised piece 4 can not be fully taken advantage of; the heat transfer rate becomes conversely low; and, further, the wind pressure loss increases to augment the air blowing power and to invite increase in noise. In order to remove such disadvantage, if a fin base plate portion 5 is provided between the adjacent cut and raised pieces 4 in the sloping shape, with its length C ranging from 1.5 to 4.0 mm, the cut and raised piece 4 in the sloping shape at the downstream side of the air flowing direction is not affected by the temperature boundary layer of the cut and raised piece 4 in the sloping shape at the upstream side of the flowing air, and its heat transfer characteristic can be fully taken advantage of. In other words, it is seen from the graphical representation of FIG. 16 that a ratio $\alpha/\Delta P$ between the heat transfer rate $\alpha$ outside the tube and the wind pressure loss $\Delta P$ becomes maximum with the total length C of the fin base plate portion 5 ranging from 1.5 to 4.0 mm in the flowing direction of the air current.

The reason for this is considered as follows. That is to say, when the total length C of the fin base plate portion 5 in the flowing direction of the air current is short, the cut and raised piece 4 in the sloping shape at the downstream side of the flowing air current is affected by the temperature boundary layer of the cut and raised piece 4 in the sloping shape at the upstream side of the flowing air current to thereby lower its heat transfer characteristic. Conversely, when the total length C of the fin base plate portion 5 in the flowing direction of the air current is long, a ratio of the total length F of the cut and raised piece 4 in the sloping shape in the flowing direction of the air current to occupy with respect to the total length A of the plate fin in the flow path direction of the air current becomes low with the consequence that the effect to be derived from the cut and raised pieces 4 in the sloping shape as a whole becomes attenuated.

Figure 17:
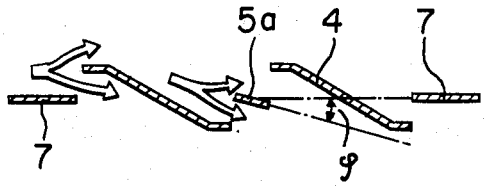
FIG. 17 is a cross-sectional view showing an angle $\phi$ of the fin base plate portion in FIG. 10 with respect to the fin base plate.

In the following, explanations will be given as to the function of the heat exchanger according to the present invention, when an angle $\phi$ of the fin base plate portion 5*a* with respect to the fin base plate 1 is set to be in a range of from zero to 15° as shown in FIG. 17. By setting the angle $\phi$ of the fin base plate portion 5*a* with respect to the fin base plate 1 in a range of from zero to 15°, the temperature boundary layer to be created at the fin base plate portion 5*a* per se, which is positioned at an intermediate location in the sinuous flow path formed by the cut and raised pieces 4 provided at both upstream and downstream sides of the air current flow, is disturbed to thereby improve a local heat transfer rate.

Figure 18:
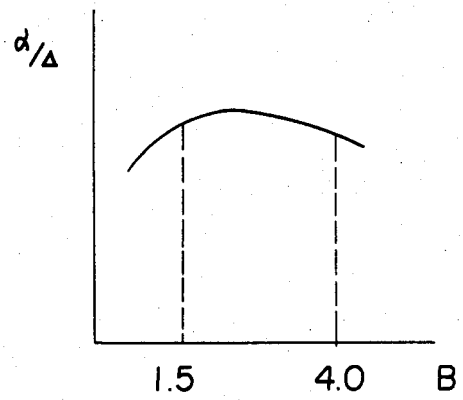
FIG. 18 is a graphical representation showing a characteristic curve concerning the length B in the flowing direction of the air current of the edges at both sides of the fin base plate shown in FIG. 10.

In the next place, explanations will be given as to the function of the heat exchanger according to the present invention, when the length B in the flowing direction of the air current of the fin base plate edge portions 7 provided at both upstream and downstream sides of the flowing air current, each extending from the end part of the fin to the edge of the cut and raised piece 4 in the sloping shape is set to be in a range of from 1.5 to 4.0 mm. It will be seen from the graphical representation in FIG. 18 that, when the length B in the flowing direction of the air current of the fin base plate edge portions 7, each extending from the fin end part to the edge of the cut and raised piece 4 in the sloping shape, is set to be in a range of from 1.5 to 4.0 mm, a ratio $\alpha/\Delta P$ between the heat transfer rate $\alpha$ outside the tube and the wind pressure loss $\Delta P$ becomes maximum in this range at the same wind velocity.

The reason for this considered as follows. That is to say, when the length B in the flowing direction of the air current of the fin base plate edge portions 7, each extending from the fin end part to the edge of the cut and raised piece 4 in the sloping shape, is long, the temperature boundary layer at this fin base plate edge portion 7 is dilated and the heat transfer characteristic becomes lowered. Also, when the length B in the flowing direction of the air current of the fin base plate edge portions 7, each extending from the fin end part to the edge of the cut and raised piece 4 in the sloping shape, becomes short, there take place such disadvantages that, if the heat exchanger constructed with the plate fins is used as an evaporator, moisture content in the air which has been condensed on the surface of the plate fins scatters out of the unit of the air conditioning apparatus to the inconvenience of the user, or the plate fins cannot maintain their required strength to become broken during their assembly as the heat exchanger.

Figure 19:
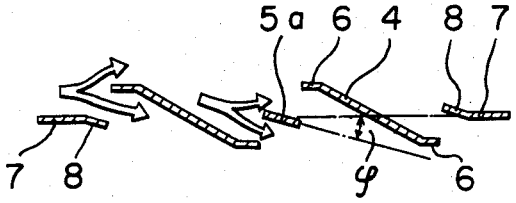
FIG. 19 is a cross-sectional view showing a state, wherein the end part of the fin base plate edge portion shown in FIG. 10 is bent at the side of the cut and raised piece in the sloping form.

The waving effect of the air flow is further augmented by bending the end part 8 of the fin base plate edge portions 7 at the side of the cut and raised piece 4 in the sloping shape, each edge portion extending from the fin end part to the edge of the cut and raised piece 4 in the slopiong shape, as shown in FIG. 19.

As has been explained in the foregoing, the heat exchanger according to the present invention is capable of remarkably improving the heat exchanging efficiency thereof due to the leading edge effect of the flat plate positioned in parallel with the flowing direction of the air current as well as the repetitive effect of the sinuous flow paths formed by the cut and raised pieces in the sloping shape, all of which are derived from provision of the fin base plate portion at the intermediate position between the adjacent cut and raised pieces in the sloping shape.

Further, since the length from the fin end part to the edge of the cut and raised piece in the sloping shape is taken sufficiently for the fin base plate edge portions, the mechanical strength of the plate fins is much more than that of the conventional plate fins, and various other effects.

So far, the present invention has been explained with reference to one preferred embodiment thereof, and further explanations of the present invention will be made in the following with reference to the second embodiment thereof as shown in FIGS. 20 to 24.

Figure 20:
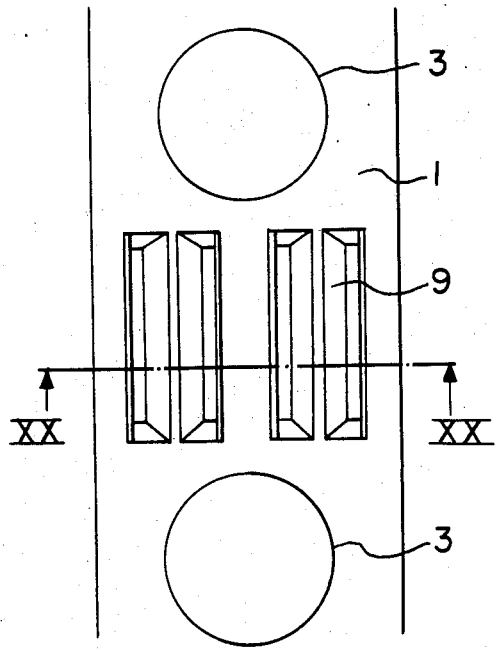
FIG. 20 is a front view, in part, showing the second embodiment of the plate fins according to the present invention.
Figure 21:
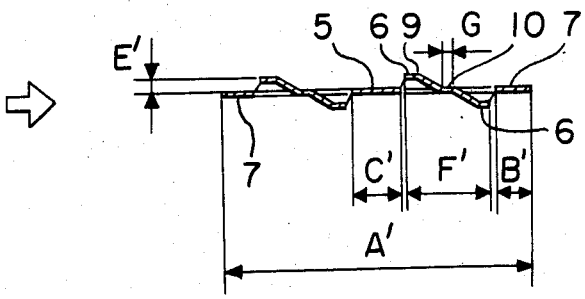
FIG. 21 is a cross-sectional view taken along a line XX—XX in FIG. 20.
Figure 22:
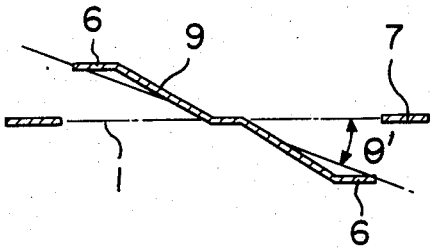
FIG. 22 is an enlarged cross-sectional view of the main part of the plate fin showing an apparent angle of inclination $\theta$ of the cut and raised piece in step form shown in FIG. 20.

Referring to the drawing, FIG. 20 is a front view showing the second embodiment of the plate fin according to the present invention, and FIG. 21 is a cross-sectional view taken along a line XX—XX in FIG. 20. In FIGS. 20 to 22, a reference numeral 1 designates the fin base plate for the plate fins having a total length A in the flow path direction of the air current. The fin base plate 1 has a plurality of holes 3, through which the heat transmission tubes are passed. A reference numeral 9 designates cut and raised pieces formed in the above-mentioned fin base plate 1 at a space between the adjacent holes 3 for permitting the heat transmission tubes to pass therethrough, and having a total length F' in the flowing direction of the air current. The cut and raised piece is so formed that a plurality of parallel incisions are made in the longitudinal direction of the above-mentioned fin base plate 1 with a planar fin base plate portion 5 having a length C' in the flowing direction of the air current being provided between the adjacent pieces, then the parallel incisions are lifted up in both front and rear surface directions of the fin base plate 1 on the march of the plane of the fin base plate 1 at a certain definite angle of inclination $\theta'$ and in certain definite directions as shown in FIG. 22 and with a definite lifting height E, thereafter the edge portions 6 on both sides of the lifted piece is re-bent in the direction opposite to the lifting direction and in substantially parallel with the surface of the fin base plate 1, and finally a step portion having a length G in the flowing direction of the air current (as shown by an arrow mark) is formed in the substantially middle part of the piece in its cross-section. In addition, fin base plate edge portions 7, each having a length B' in the air flowing direction and extending from the fin end part to the edge of the above-mentioned cut and raised piece 9 in the step form are arranged at both upstream and downstream sides with respect to the flowing direction of the air current. The dimensional relationship among these parts constituting the cut and raised piece and the fin base plate portion are in the ranges to be mentioned in the following: that is, the total length F' of the cut and raised piece 9 in the step form in the flowing direction of the air current is set to be in a range of from 4.0 to 6.0 mm; a relational equation of F'/(A'/NR') among the total length A' of the plate fin in the flow path direction of the air current, the number of rows NR' of a group of heat transmission tubes in the direction orthogonally intersecting with the air flowing direction (when such group of heat transmission tubes is called 'row'), and the total length F' in the flowing direction of the air current of the cut and raised piece 9 in the step form is set to be in a range of from 0.15 to 0.4; the lifting height E' of the cut and raised piece 9 in the step form is set to be in a range of from 0.7 to 0.9 mm; the length C' of the fin base plate portion 5 at an intermediate position between the adjacent cut and raised pieces 9 in the step form is in a range of from and a ratio C'/F' between the length C' of the fin base plate portion 5 and the length F' of the cut and raised piece 9 in the step form in the flowing direction of the air current is set to be in a range of from 0.4 to 0.8. Further, the length B' of the fin base plate edge portions 7 positioned at both upstream and downstream sides with respect to the air flowing direction, and each extending from the fin end part to the edge of the cut and raised piece 9 in the step form, is set to be in a range of from 1.5 to 4.0 mm, and the length G in the flowing direction of the air current of the flat surface 10 which is in parallel with the air flowing direction and positioned at the substantially center of the cut and raised piece 9 in the step form is set to be in a range of from 0.6 to 1.5 mm.

Figure 23:
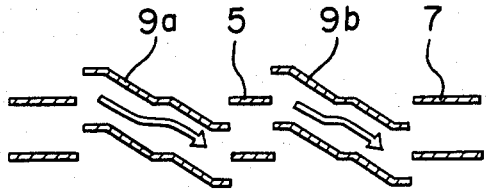
FIG. 23 is a cross-sectional view showing a state of a plurality of plate fins shown in FIG. 20 being arranged in juxtaposition.
Figure 24:
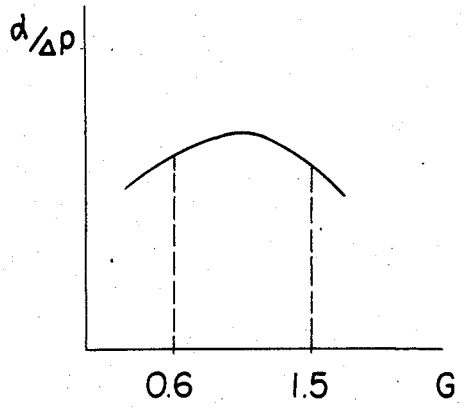
FIG. 24 is a graphical representation showing characteristic curve concerning the length G of a flat plane at the center of the cut and raised piece in the step form shown in FIG. 20, which is parallel with the direction of the air flow.

When the fin base plates 1, each being of a construction as described in the foregoing, are arranged in juxtaposition as shown in FIG. 23 to build a heat exchanger, since the cut and raised piece 9 is formed in a stepped shape, the cut and raised pieces 9 in one plate fin and those in the next adjacent plate fin among multitude of the plate fins arranged in juxtaposition form a plurality of sinuous flow paths for the air current. The air current passing through these sinuous flow paths is subjected to the direction changing for plural numbers of times, during which passage the boundary layer of the air current as a whole becomes thin due to the repetitive effect of the running sections for the air current and the heat transfer rate increases.

In addition, presence of the fin base plate portion 5 between the adjacent cut and raised pieces 9 elongates the distance between these adjacent cut and raised pieces 9 with the consequence that the boundary layer which is liable to give influence on the leading edge part of the cut and raised piece substantially disappears, unlike the conventional heat exchanger, and the leading edge effect of the cut and raised piece 9 at the downstream side of the air flow can be fully taken advantage of, thereby making it possible to obtain a high heat transfer rate. Further, unlike the conventional heat exchanger, there is no possiblility of the leading edge effect being hindered by the influence of the boundary layer between the cut and raised pieces 9 in the mutually juxtaposed and adjacent plate fins, as shown in FIG. 23.

The leading edge parts of the cut and raised pieces 9 and the fin base plate portions 5 in the plate fins are all arranged in the offset positions with respect to the flowing direction of the air current, and, in addition, the cut and raised piece 9 at the downstream side of the air current and the fin base plate portion 5 are so arranged that the growing direction of the boundary layer may not be present in one and the same plane, so that, even when the growing direction becomes identical, since the cut and raised pieces are sufficiently distant apart, the boundary layer at the leading edge part disappears to a substantial extent so as not to give influence on the leading edge effect at that part. Moreover, since the structure of the plate fins is not so inconvenient as to create splitting or turbulence of the air flow, which would cause decrease in the heat transmission characteristic and increase in the wind pressure loss, the air flow can be kept smooth.

Incidentally, since the abovementioned cut and raised piece 9 has its edge parts 6,6 at both side thereof re-bent in the direction opposite to their lifting, the fin can get sufficient mechanical strength. Moreover, since the adjacent cut and raised pieces 9, 9 are amply spaced apart each other, in comparison with the conventional heat exchanger, the mechanical strength of the plate fin can also be increased.

In the following, the function of the heat exchanger will be explained when the total length of the abovementioned cut and raised piece 9 in the step form in the flowing direction of the air current is designated F' and its value is set to be in a range of from 4.0 to 6.0 mm. As has already been mentioned, since the cut and raised pieces 4 in the stepped form are provided, there is formed a sinuous air flow path with the cut and raised portions 9,9 in the mutually adjacent plate fins, and, owing to the repetitive effect of the running section for the air flow, the temperature boundary layer disappears to thereby remarkably improve the heat transmission performance. It will be seen here that, when the total length F' of the cut and raised piece 9 in the step form in the flowing direction of the air current is set to be in a range of from 4.0 to 6.0 mm, a ratio $\alpha/\Delta P$ between a heat transfer rate $\alpha$ outside the tube and a wind pressure loss $\Delta P$, which is one of the important factors to determine the performance of the heat exchanger, becomes the maximum in this range at the same wind velocity as shown in FIG. 12, as is the case with the afore-described first embodiment of the present invention.

The reasons for this is considered as follows. When the total length F' of the cut and raised piece 9 in the step form in the flowing direction of the air current is short, the angle of inclination $\theta$ for lifting the piece should be made large in order to maintain constant the lifting height E' of the piece with the consequent parting of the air current to take place at the downstream of the edge parts 6 on both sides of the cut and raised piece 9 in the step form, which is liable to lower the heat transfer performance. On the contrary, when the angle of inclination $\theta'$ is kept constant, the lifting height E' becomes low and the cut and raised piece 9 comes into the thickness of the temperature boundary layer to be formed in the inflow direction of the air current to make it difficult to fully take advantage of the leading edge effect of the boundary layer which promotes the heat transfer effect, whereby the heat transfer performance of the heat exchanger decreases. On the other hand, when the total length F' in the flowing direction of the air current of the cut and raised piece 9 in the step form is long, the lifting height E' of the piece is restricted by the space interval between the adjacent plate fins and the angle of inclination $\theta'$ for lifting the piece becomes small, on account of which the repetitive effect of the air running sections in the sinuous flow paths, which promotes the heat transfer effect, cannot be fully taken advantage of, and the heat transfer performance of the heat exchanger decreases.

In the following, explanations will be made as to the function of the heat exchanger, when a relational equation F'/(A'/NR') is set to be in a range of from 0.15 to 0.4, where A' is the total length of the plate fin in the flow path direction of the air current, NR' denotes the number of rows of the group of heat transmission tubes passing in the direction orthogonal to the air current (when such group of heat transmission tubes is called 'row'), and F' represents a length in the flowing direction of the air current of the cut and raised piece 9 in the step form. As has already been mentioned in the foregoing, since the cut and raised pieces 9 in the step form are provided, the cut and raised pieces in the mutually adjacent plate fins form a sinuous flow path, and, owing to the repetitive effect of the running sections for the air current, the temperature boundary layer becomes extinct to remarkably improve the heat transfer performance of the heat exchanger.

When a relational equation of F'(A'/NR') is set to be in a range of from 0.15 to 0.4, where A' denotes the total length of the plate fin in the flow path direction of the air current, NR' indicates the number of rows of the group of heat transmission tubes passing in the direction orthogonal to the air current (when such group of heat transmission tubes is called 'row'), and F' represents a length in the flowing direction of the air current of the cut and raised piece 9 in the step form, it will be seen that a ratio $\alpha/\Delta P$ between a heat transfer rate $\alpha$ outside the tube and a wind pressure loss $\Delta P$, which is one of the important factors to determine the performance of the heat exchanger, becomes the maximum in this range at the same wind velocity, as shown in FIG. 13, as is the case with the afore-described first embodiment.

The reason for this is considered as follows. That is to say, when the total length F' in the flowing direction of the air current of the cut and raised piece 9 in the step form is shorter than a length A'/NR' of the plate fin per row of the heat transmission tubes in the flow path direction of the air current, a ratio of the cut and raised pieces to occupy the overall plate fin becomes low with the consequence that a degree of improvement in the heat transfer performance due to the lifting effect of the piece tends to be low. On the other hand, when the total length F' in the flowing direction of the air current of the cut and raised piece 9 in the step form becomes longer than the length A'/NR' of the plate fin per row of the heat transmission tubes in the flow path direction of the air current, the temperature field of the boundary layer to be formed by the cut and raised pieces 9 at the upstream side with respect to the air current, out of the mutually adjacent cut and raised pieces, would inevitably affect the cut and raised pieces 9 at the downstream side, as seen in the afore-described conventional heat exchanger, with the consequence that the leading edge effect of the cut and raised piece 9 at the downstream side cannot be fully taken advantage of; the heat transfer rate becomes conversely low; and, further, the wind pressure loss increases to invite augmentation in the air blowing power and noises from the blower, hence the heat transfer performance cannot be attained to the maximum possible level.

In the following, explanations will be given as to the function of the heat exchanger, when an acute angle formed by a straight line connecting the edge parts 6, 6 on both sides of the cut and raised piece 9 in the step form and the fin base plate 1, as shown in FIG. 22, is made an apparent angle of inclination $\theta'$ of the cut and raised piece 9 in the step form, and this angle is set to be in a range of from 18° to 34°. As has already been mentioned in the foregoing, since the cut and raised pieces 9 in the step form are provided, the cut and raised pieces in the mutually adjacent plate fins form a sinuous flow path, and, owing to the repetitive effect of the running sections for the air flow, the temperature boundary layer disappears and the heat transfer performance of the heat exchanger is remarkably improved. And, here, when the apparent angle of inclination $\theta'$ of the cut and raised piece 9 in the step form is set to be in a range of from 18° to 34°, the heat transfer rate $\alpha$ outside the tube and the wind pressure loss $\Delta P$, which are the important factors for determining the performance of the heat exchanger, vary as shown in FIG. 14 at the same wind velocity, as is the case with the afore-described first embodiment. That is to say, the ratio $\alpha/\Delta P$ between the heat transfer rate $\alpha$ outside the tube and the wind pressure loss $\Delta P$ varies as shown in FIG. 15, from which it is seen that the maximum value for the ratio is attained with the apparent angle of inclination $\theta'$ of the cut and raised piece in the step form ranging from 18° to 35°.

The reason for this is considered as follows. That is to say, when the apparent angle of inclination $\theta'$ of the cut and raised piece 9 in the step form is small, the cut and raised piece 9 in the step form is included in the thickness of the temperature boundary layer to be formed in the inflow direction of the air current to make it difficult to take full advantage of the effect to be derived from the cut and raised piece, whereby the heat transmission characteristic becomes reduced. On the contrary, when the apparent angle of inclination $\theta'$ of the cut and raised piece 9 in the step form is large, there takes place splitting of the air current at the downstream edge 6 of the cut and raised piece 9 in the step form, the wind pressure loss increases, and the heat transfer characteristic as the heat exchanger lowers.

In the following, explanations will be given as to the function of the heat exchanger when the lifting height E' of the cut and raised piece 9 in the step form is set to be in a range of from 0.7 to 0.9 mm. As has so far been mentioned, when restrictions are imposed on the total length F' in the flowing direction of the air current of the cut and raised piece 9 in the step form and on the apparent angle of inclination $\theta'$ of the cut and raised piece 9 in the step form, the lifting height E' of the cut and raised piece 9 in the step form is determined naturally. However, the lifting height E' of the cut and raised piece 9 in the step form according to the present invention is very important in conjunction with the relationship among the juxtaposed plate fins, which can be said to be a peculiar effect with the cut and raised piece 9 in the step form according to the present invention.

In the next place, explanations will be made as to the function of the heat exchanger, when the length C' in the air flowing direction of the fin base plate portion 5 positioned between the adjacent cut and raised pieces 9 in the step form is set to be in a range of from 1.5 to 4.0 mm, and a ratio C'/F' between the length C' of the fin base plate portion 5 in the air flowing direction and the length F' of the cut and raised piece 9 in the step form in the air flowing direction is set to be in a range of from 0.4 to 0.8. Since the cut and raised pieces in the step form are provided, those cut and raised pieces in the mutually adjacent plate fins form sinuous flow paths for the air current, and, owing to the repetitive effect of the air current running sections, the temperature boundary layer dies out to remarkably improve the heat transfer performance of the heat exchanger, as has already been mentioned in the foregoing. However, as seen in the conventional heat exchanger, if the adjacent cut and raised pieces 9 in the step form are too close, the cut and raised pieces in the step form situated at the downstsream side of the air flowing direction is affected by the temperature field in the boundary layer to be formed by the cut and raised pieces 9 situated at the upstream side with respect to the air current (as shown by an arrow mark), out of the respective cut and raised pieces 9. As the consequence of this, the leading edge effect of the cut and raised piece 9 cannot be fully taken advantage of; the heat transfer rate thereof becomes conversely low; and, further, the wind pressure loss increases to augment the air blowing power to invite increase in noise of the air blowing device. In order to eliminate such disadvantage, when a fin base plate portion 5 is provided between the adjacent cut and raised pieces 9 in the step form with its length C' set to be in a range of from 1.5 to 4.0 mm, the cut and raised pieces 9 at the downstream side of the air flowing direction is not affected by the temperature boundary layer of the cut and raised pieces 9 in the step form at the upstream side of the air current flow, and its heat transfer characteristic can be fully taken advantage of. In other words, it is seen from the graphical representation of FIG. 16 that a ratio $\alpha/\Delta P$ between the heat transfer rate $\alpha$ outside the tube and the wind pressure loss $\Delta P$ becomes maximum with the total length C' of the fin base plate portion 5 in the air flowing direction ranging from 1.5 to 4.0 mm, as is the case with the afore-described first embodiment of the present invention.

The reason for this is considered as follows. That is to say, when the total length C' of the fin base plate portion 5 in the air flowing direction is short, the cut and raised pieces 9 in the step form at the downstream side of the air flowing direction is affected by the temperature boundary layer of the cut and raised pieces 9 in the step form at the upstream side of the air current flow to thereby lower its heat transfer characteristic. Conversely, when the total length C' of the fin base plate portion 5 in the air flowing direction is long, a ratio of the total length C' in the air flowing direction of the cut and raised piece 9 in the step form occupying in the total length A' of the plate fin in the flow path direction of the air current becomes low with the consequence that the effect to be derived from the cut and raised piece 9 in the step form as a whole becomes attenuated.

Figure 25:
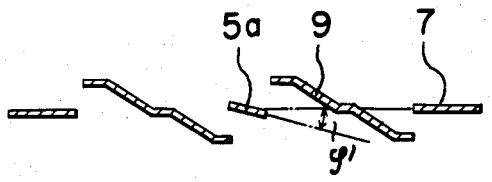
FIG. 25 is a cross-sectional view showing an angle $\phi$ of the fin base plate portion in FIG. 20 with respect to the fin base plate.
Figure 26:
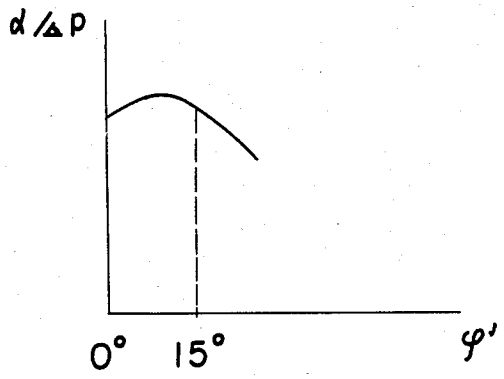
FIG. 26 is a graphical representation showing a characteristic curve concerning the angle of inclination $\phi'$ in FIG. 25.

In the following, explanations will be given as to the function of the heat exchanger according to the present invention, when an angle $\phi'$ of the fin base plate portion 5*a* with respect to the fin base plate 1 is set to be in a range of from zero to 15° as shown in FIG. 25. By setting the angle $\phi'$ of the fin base plate portion 5*a* with respect to the fin base plate 1 in a range of from zero to 15°, the temperature boundary layer to be created at the fin base plate portion 5*a* per se, which is positioned at an intermediate location in the sinuous flow path formed by the cut and raised pieces 9 provided at both upstream and downstream sides of the air flowing direction, is disturbed to thereby improve a local heat transfer rate, as is the case with the afore-described first embodiment of the present invention. It will be seen from the graphical representation in FIG. 26 that a ratio $\alpha/\Delta P$ between the heat transfer rate $\alpha$ outside the tube and the wind pressure loss $\Delta P$ varies as shown by the curve, which ratio becomes maximum at an angle of inclination $\phi'$ of the fin base plate portion 5*a* to the fin base plate 1 ranging from zero to 15°.

In the following, explanations will be given as to the function of the heat exchanger according to the present invention, when the length B' in the flowing direction of the air current of the fin base plate edge portions 7, 7 at both upstream and downstream sides, each extending from the fin end part to the edge of the cut and raised piece 9 in the step form, is set to be in a range of from 1.5 to 4.0 mm. It is seen that, when the length B' in the flowing direction of the air current of the fin base plate edge portion 7 extending from the fin end part to the edge of the cut and raised piece 9 in the step form is set to be in a range of from 1.5 to 4.0 mm, a ratio $\alpha/\Delta P$ between the heat transfer rate $\alpha$ outside the tube and the wind pressure loss $\Delta P$ becomes maximum in that range at the same wind velocity, as is the case with the afore-described first embodiment of the present invention shown in FIG. 18.

The reason for this is considered as follows. That is to say, when the length B' in the flowing direction of the air current of the fin base base plate edge portion 7 extending from the fin end part to the edge of the cut and raised piece 9 in the step form becomes long, the temperature boundary layer at this fin base plate edge portion 7 is developed and the heat transfer characteristic becomes lowered. On the contrary, when the length B' in the flowing direction of the air current of the fin base plate edge portion 7 extending from the fin end part to the edge of the cut and raised piece 9 in the step form becomes short, there take place disadvantages such that, if the heat exchanger constructed with the plate fins is used as an evaporator, moisture content in the air which has been condensed on the surface of the plate fins scatters out of the air conditioning apparatus to the inconvenience of the user, or the plate fins cannot maintain their required mechanical strength to become broken during their assembly as the heat exchanger.

In the following, explanations will be given as to the function of the heat exchanger of the present invention, when the length G in the air flowing direction of the flat surface 10, which is in parallel with the air flowing direction and positioned in the middle of the cut and raised piece 9 in the step form, is set to be in a range of from 0.6 to 1.5 mm. It is seen from FIG. 24 that, when the length G in the flowing direction of the air current of the flat surface 10, which is in parallel with the air flowing direction and positioned in the middle of the cut hand raised piece 9 in the step form, is set to be in a range of from 0.6 to 1.5 mm, a ratio $\alpha/\Delta P$ between the heat transfer rate $\alpha$ outside the tube and the wind pressure loss $\Delta P$ becomes maximum in that specific range at the same wind velocity.

The reason for this is considered as follows. That is to say, when the length G in the air flowing direction of the air current of the flat surface 10, which is in parallel with the air flowing direction and positioned in the middle of the cut and raised piece 9 in the step form, is short, the effect of promoting the heat transfer effect due to the repeating sinuous flow paths for the air current to be formed by the cut and raised pieces 9, 9 in the mutually juxtaposed plate fins becomes reduced. On the contrary, when the length G in the flowing direction of the air current of the flat surface 10, which is in parallel with the air flowing direction and positioned in the middle of the cut and raised piece 9, is long, there takes splitting of the air current at the edge portions 6, 6 on both sides of the cut and raised piece 9, which splitting is liable to increase the wind pressure loss.

Figure 27:
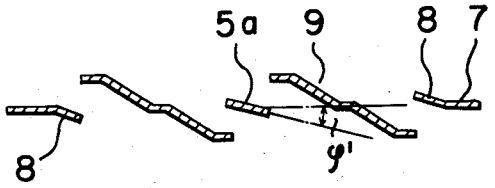
FIG. 27 is a cross-sectional view showing a state, wherein the end part of the fin base plate edge portion shown in FIG. 20 is bent at the side of the cut and raised piece.

Further, the curving effect of the air current can be augmented by bending the end part 8 of the fin base plate edge portion 7, extending from the fin end part to the edge of the cut and raised piece 9 in the step form, at the side of the cut and raised piece 9 in the step form, as shown in FIG. 27.

Figure 28:
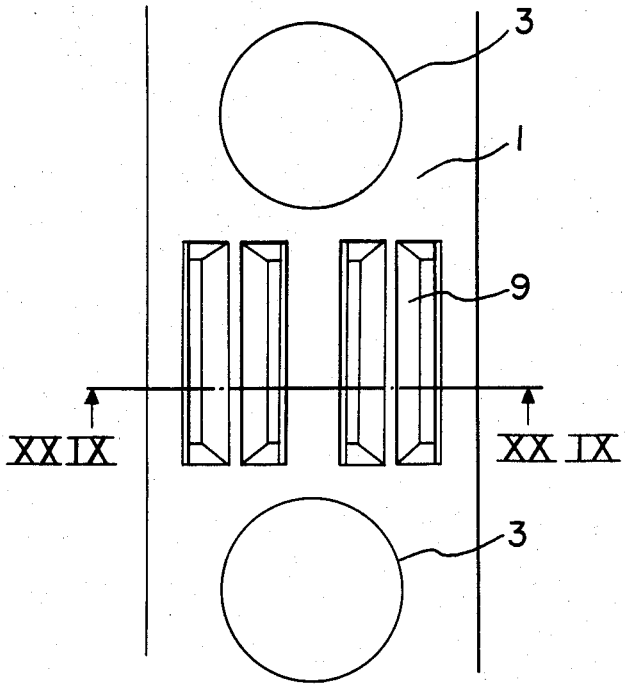
FIG. 28 is a front view, in part, showing the third embodiment of the plate fins according to the present ivnention.
Figure 29:
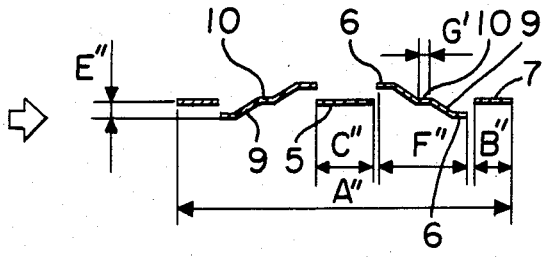
FIG. 29 is a cross-sectional view taken along a line XXIX—XXIX in FIG. 28.
Figure 30:
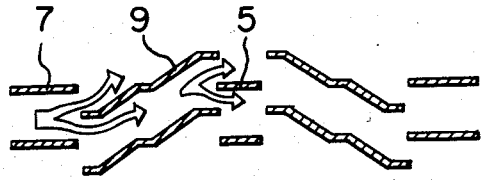
FIG. 30 is a cross-sectional view showing a state, wherein a plurality of plate fins shown in FIG. 29 are arranged in juxtaposition.

In the following, the present invention will be explained with reference to the third embodiment shown in FIGS. 28 and 29 which illustrate, respectively, a front view of the plate fin according to this third embodiment of the present invention, and a cross-sectional view taken along a line XXIX—XXIX in FIG. 28. In FIGS. 28 to 30, a reference numeral 1 designates the fin base plate for the plate fins having a total length A'' in the flow path direction of the air current. The fin base plate 1 has a plurality of holes 3, through which the heat transmitting tubes are passed. A reference numeral 9 designates a cut and raised piece formed in the above-mentioned fin base plate 1 at a space between the adjacent holes 3 for permitting the heat transmitting tubes to pass therethrough, and having a total length F'' in the flowing direction of the air current. The cut and raised piece is so formed that a plurality of parallel incisions are made in the longitudinal direction of the above-mentioned fin base plate 1 with a planar fin base plate portion 5 having a length C'' in the flowing direction of the air current being provided between the adjacent pieces, then the parallel incisions are lifted up in both front and rear surface directions of the fin base plate 1 on the march of the plane of the fin base plate 1 at a certain definite angle of inclination $\theta'$ and in certain definite directions as shown in FIG. 22 and with a definite lifting height E'', thereafter the edge portions 6 on both sides of the lifted piece is re-bent in the direction opposite to the lifting direction and in substantially parallel with the surface of the fin base plate 1, and finally a step portion having a length G' in the flowing direction of the air current (as shown by an arrow mark) is formed in the substantially middle part of the piece in its cross-section. Further, the mutually adjacent cut and raised pieces in one plate fin are so formed that they are lifted up in opposite directions each other with respect to the fin base plate 1. In addition, fin base plate edge portions 7, each having a length B″ in the air flowing direction and extending from the fin end part to the edge of the above-mentioned cut and raised piece 9 in the step form are arranged at both upstream and downstream sides with respect to the flowing direction of the air current. The dimensional relationship among these parts constituting the cut and raised piece and the fin base plate portion are in the ranges to be mentioned in the following: that is, the total length F″ of the cut and raised piece 9 in the step form in the flowing direction of the air current is set to be in a range of from 4.0 to 6.0 mm; a relationship among the total length A″ of the plate fin in the flow path direction of the air current, the number of rows NR″ of a group of heat transmission tubes in the direction orthogonally intersecting with the air flowing direction (when such group of heat transmission tubes is called 'row'), and the total length F″ in the flowing direction of the air current of the cut and raised piece 9 in the step form, when expressed in terms of a relational equatio of F″/(A″/NR″), is set to be in a range of from 0.15 to 0.4; the lifting height E″ of the cut and raised piece 9 in the step form is set to be in a range of from 0.7 to 0.9 mm; the length C″ of the fin base plate portion 5 at an intermediate position between the adjacent cut and raised pieces 9 in the step form is set to be in a range of from 1.5 to 4.0 mm; and a ratio C″/F″ between the length C″ of the fin base plate portion 5 and the length F″ of the cut and raised piece 9 in the step form in the flowing direction of the air current is set to be in a range of from 0.4 to 0.8. Further, the length B″ of the fin base plate edge portions 7 positioned at both upstream and downstream sides with respect to the air flowing direction, and each extending from the fin end part to the edge of the cut and raised piece 9 in the step form, is set to be in a range of from 1.5 to 4.0 mm, and the length G′ in the flowing direction of the air current of the flat surface 10 which is in parallel with the air flowing direction and positioned at the substantially center of the cut and raised piece 9 in the step form is set to be in a range of from 0.6 to 1.5 mm.

When the fin base plates 1, each being of a construction as described in the foregoing, are arranged in juxtaposition as shown in FIG. 30 to build a heat exchanger, since the cut and raised piece 9 is formed in a stepped shape, the cut and raised pieces 9 in one plate fin and those in the next adjacent plate fin among multitude of the plate fins arranged in juxtaposition form a plurality of sinuous flow paths for the air current. The air current passing through these sinuous flow paths is subjected to the direction changing for plural numbers of times, during which passage the boundary layer of the air current as a whole becomes thin due to the repetitive effect of the running sections for the air current and the heat transfer rate increases.

In addition, presence of the fin base plate portion 5 between the abovementioned adjacent cut and raised pieces 9 elongates the distance between these adjacent cut and raised pieces 9 with the consequence that the boundary layer which is liable to give influence on the leading edge part of the cut and raised piece disappears to a substantial extent, unlike the conventional heat exchanger, and the leading edge effect of the cut and raised piece 9 at the downstream side of the air flow can be fully taken advantage of, thereby making it possible to obtain a high heat transfer rate. Further, unlike the conventional heat exchanger, there is no possibility of the front edge effect being hindered by the influence of the boundary layer bewtween the cut and raised pieces 9 in the mutually juxtaposed and adjacent plate fins, as shown in FIG. 30.

The leading edge parts of the cut and raised pieces 9 and the fin base plate portions 5 in the plate fins are all arranged in the offset positions with respect to the flowing direction of the air current, and, in addition, the cut and raised piece 9 at the downstream side of the air current and the fin base plate portion 5 are so arranged that the growing direction of the boundary layer may not be present in one and the same plane, so that, even when the growing direction becomes identical, since the cut and raised pieces are sufficiently distant apart, the boundary layer at the leading edge part disappears to a substantial extent so as not to give influence on the front edge effect at that part. Moreover, since the structure of the plate fins is not so inconvenient as to create splitting or turbulence of the air flow, which would cause decrease in the heat transmission characteristic and increase in the wind pressure loss, hence the air flow can be kept smooth.

Incidentally, since the abovementioned cut and raised piece 9 has its edge parts 6, 6 at both sides thereof rebent in the direction opposite to their lifting, the fin can get sufficient mechanical strength. Moreover, since the adjacent cut and raised pieces 9, 9 are amply spaced apart each other, in comparison with the conventional heat exchanger, the mechanical strength of the plate fin can also be increased. Moreover, as seen from the cross-section of the fin, the cut and raised pieces 9 in the step form are symmetrically arranged on the march of the fin base plate portion 5, there is no problem of twisting of the fins to take place at the time of the machining.

In the following, the function of the heat exchanger according to the present invention will be explained when the total length of the abovementioned cut and raised piece 9 in the step form in the flowing direction of the air current is designated F″ and its value is set to be in a range of from 4.0 to 6.0 mm. As has already been mentioned, since the cut and raised pieces 4 in the stepped form are provided, there is formed a sinuous air flow path with the cut and raised portions 9, 9 in the mutually adjacent plate fins, and, owing to the repetitive effect of the running sections for the air flow, the temperature boundary layer disappears to thereby remarkably improve the heat transmission performance. It will be seen here that, when the total length F″ of the cut and raised piece 9 in the step form in the flowing direction of the air current is set to be in a range of from 4.0 to 6.0 mm, a ratio $\alpha/\Delta P$ between a heat transfer rate $\alpha$ outside the tube and a wind pressure loss $\Delta P$, which is one of the important factors to determine the performance of the heat exchanger, becomes the maximum in this range at the same wind velocity, as is the case with the afore-described first and second embodiments shown in FIG. 12.

The reason for this is considered as follows. When the total length F″ in the flowing direction of the air current of the cut and raised piece 9 in the step form is short, the angle of inclination $\theta''$ for lifting the piece in the step form should be made large in order to maintain constant the lifting height E″ of the piece with the consequent parting of the air current to take place at the downstream of the edge parts 6, 6 on both sides of the cut and raised piece 9 in the step form, which is liable to lower the heat transfer performance. On the contrary, when the angle of inclination $\theta''$ for lifting the piece in the step form is kept constant, the lifting height E″ becomes low and the cut and raised piece 9 comes into the thickness of the temperature boundary layer to be formed in the inflow direction of the air current to make it difficult to fully take advantage of the leading edge effect of the boundary layer which promotes the heat transfer effect, whereby the heat transfer performance of the heat exchanger decreases. On the other hand, when the total length F″ in the flowing direction of the air current of the cut and raised piece 9 in the step form is long, the lifting height E″ of the piece is restricted by the space interval between the adjacent plate fins and the angle of inclination $\theta''$ for lifting the piece becomes small, on account of which the repetitive effect among the air running sections in the sinuous flow paths, which promotes the heat transfer effect, cannot be fully taken advantage of, and the heat transfer performance of the heat exchanger decreases.

In the following, explanations will be made as to the function of the heat exchanger, when a relational equation F″/(A″/NR″) is set to be in a range of from 0.15 to 0.4, where A″ is the total length of the plate fin in the flow path direction of the air current, NR″ denotes the number of rows of the group of heat transmission tubes passing in the direction orthogonal to the air current (when such group of heat transmission tubes is called 'row'), and F″ represents a length in the flowing direction of the air current of the cut and raised piece 9 in the step form. As has already been mentioned in the foregoing, since the cut and raised pieces 9 in the step form are provided, the cut and raised pieces in the adjacent plate fins form a sinuous flow path, and, owing to the repetitive effect of the running sections for the air current, the temperature boundary layer becomes extinct to remarkably improve the heat transfer performance of the heat exchanger.

And, when a relational equation of F″/(A″/NR″) is set to be in a range of from 0.15 to 0.4, where A″ denotes the total length of the plate fin in the flow path direction of the air current, NR″ indicates the number of rows of the group of heat transmission tubes passing in the direction orthogonal to the air current (when such group of the heat transmission tubes is called 'row'), and F″ represents a length in the flowing direction of the air current of the cut and raised piece 9 in the step form, it will be seen that a ratio $\alpha/\Delta P$ between a heat transfer rate $\alpha$ outside the tube and a wind pressure loss $\Delta P$, which is one of the important factors to determine the performance of the heat exchanger, becomes the maximum in this range at the same wind velocity as is the case with the afore-described first and second embodiments shown in FIG. 13.

The reason for this is considered as follows. That is to say, when the total length F″ in the flowing direction of the air current of the cut and raised piece 9 in the step form is shorter than a length A″/NR″ of the plate fin per row of the heat transmission tubes with respect to the flow path direction of the air current, a ratio of the cut and raised pieces occupying in the overall plate fin becomes low with the consequence that a degree of improvement in the heat transfer performance due to the lifting effect of the piece tends to be low. On the other hand, when the total length F″ in the flowing direction of the air current of the cut and raised piece 9 in the step form becomes longer than the length A″/NR″ of the plate fin per row of the heat transmission tubes in the flow path direction of the air current, the temperature field of the boundary layer to be formed by the cut and raised pieces 9 at the upstream side with respect to the air current, out of the mutually adjacent cut and raised pieces, would inevitably affect the cut and raised pieces 9 at the downstream side, as seen in the afore-described conventional heat exchanger, with the consequence that the leading edge effect of the cut and raised piece 9 at the downstream side cannot be fully taken advantage of; the heat transfer rate becomes conversely low; and, further, the wind pressure loss increases to invite augmentation in the air blowing power and noises from the blower, hence the heat transfer performance cannot be attained to the maximum possible level.

Figure 31:
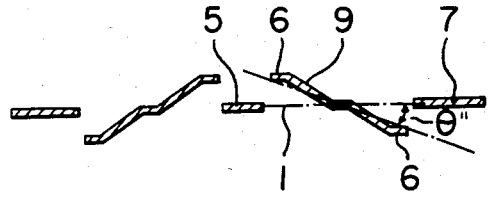
FIG. 31 is a cross-sectional view showing an apparent angle of inclination $\theta''$ of the cut and raised piece in the step form shown in FIG. 29.

In the following, explanations will be given as to the function of the heat exchanger, when an acute angle formed by a straight line connecting the edge parts 6, 6 on both sides of the cut and raised piece 9 in the step form and the fin base plate 1, as shown in FIG. 31, is made an apparent angle of inclination $\theta''$ of the cut and raised piece 9 in the step form, and this angle is set to be in a range of from 18° to 34°. As has already been mentioned in the foregoing, since the cut and raised pieces 9 in the step form are provided, the cut and raised pieces in the mutually adjacent plate fins form sinuous flow paths, and owing to the repetitive effect of the running sections for the air flow, the temperature boundary layer disappears and the heat transfer performance of the heat exchanger is remarkably improved. And, here, when the apparent angle of inclination $\theta''$ of the cut and raised piece 9 in the step form is set to be in a range of from 18° to 34°, the heat transfer rate $\alpha$ outside the tube and a wind pressure loss $\Delta P$, which are the important factors for determining the performance of the heat exchanger, vary as shown in FIG. 14 at the same wind velocity as is the case with the first and second embodiments. That is to say, the ratio $\alpha/\Delta P$ between the heat transfer rate $\alpha$ outside the tube and the wind pressure loss $\Delta P$ varies as shown in FIG. 15, from which it is seen that the maximum value for the ratio is attained with the apparent angle of inclination $\theta''$ of the cut and raised piece 9 in the step form ranging from 18° to 35°.

The reason for this is considered as follows. That is to say, when the apparent angle of inclination $\theta''$ of the cut and raised piece 9 in the step form is small, the cut and raised piece 9 in the step form is included in the thickness of the temperature boundary layer to be formed in the inflow direction of the air current to make it difficult to take full advantage of the effect to be derived from the cut and raised piece, whereby the heat transmission characteristic becomes reduced. On the contrary, when the apparent angle of inclination $\theta''$ of the cut and raised piece 9 in the step form is large, there takes place splitting of the air current at the downstream edge 6 of the cut and raised piece 9 in the step form, the wind pressure loss increases, and the heat transfer characteristic as the heat exchanger lowers.

In the following, explanations will be given as to the function of the heat exchanger when the lifting height E″ of the cut and raised piece 9 in the step form is set to be in a range of from 0.7 to 0.9 mm. As has so far been mentioned, when restrictions are imposed on the total length F″ in the flowing direction of the air current of the cut and raised piece 9 in the step form and on the apparent angle of inclination $\theta''$ of the cut and raised piece 9 in the step form, the lifting height E″ of the cut and raised piece 9 in the step form is determined naturally. However, the lifting height E″ of the cut and raised piece 9 in the step form according to the present invention is very important in conjunction with the relationship among the juxtaposed plate fins, which can be said to be a peculiar effect with the cut and raised piece 9 in the step form according to the present invention.

Figure 16:
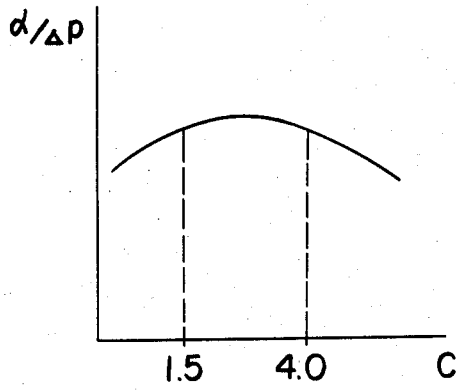
FIG. 16 is a graphical representation showing a characteristic curve concerning the length C in the direction of the air flow of the fin base plate portion shown in FIG. 10.

In the next place, explanations will be made as to the function of the heat exchanger, when the length C″ in the air flowing direction of the fin base plate portion 5 positioned between the adjacent cut and raised pieces 9 in the step form is set to be in a range of from 1.5 to 4.0 mm, and a ratio C″/F″ between the length C″ of the fin base plate portion 5 in the air flowing direction and the length F″ of the cut and raised piece 9 in the step form in the air flowing direction is set to be in a range of from 0.4 to 0.8. As has already been described in the foregoing, since the cut and raised pieces in the step form are provided, these cut and raised pieces in the adjacent plate fins form sinuous flow paths for the air current, and, owing to the repetitive effect of the air current running sections, the temperature boundary layer dies out to remarkably improve the heat transfer performance of the heat exchanger. However, as seen in the conventional heat exchanger, if the adjacent cut and raised pieces 9 in the step form are too close, the cut and raised piece 9 in the step form situated at the downstream side of the flowing direction of the air current is affected by the temperature field in the boundary layer to be formed by the cut and raised piece 9 situated at the upstream side with respect to the air current, out of the respective cut and raised pieces 9. As the consequence of this, the leading edge effect of the cut and raised piece 9 cannot be fully taken advantage of; the heat transfer rate thereof becomes conversely low; and, further, the wind pressure loss increases to augment the air blowing power to invite increase in noise of the air blowing device. In order to eliminate such disadvantage, when a fin base plate portion 5 is provided between the adjacent cut and raised pieces 9 in the step form with its length C″ set to be in a range of from 1.5 to 4.0 mm, the cut and raised pieces 9 at the downstream side of the air flowing direction is no longer affected by the temperature boundary layer of the cut and raised piece 9 in the step form at the upstream side of the air current flow, and its heat transfer characteristic can be fully taken advantage of. In other words, it is seen from the graphical representation of FIG. 16 that a ratio $\alpha/\Delta P$ between a heat transfer rate $\alpha$ outside the tube and the wind pressure loss $\Delta P$ becomes maximum with the total length C″ of the fin base plate portion 5 in the air flowing direction ranging from 1.5 to 4.0 mm, as is the case with the afore-described first and second embodiments of the present invention as shown in FIG. 16.

The reason for this is considered as follows. That is to say, when the total length C″ of the fin base plate portion 5 in the air flowing direction is short, the cut and raised piece 9 in the step form in the air flowing direction is affected by the temperature boundary layer of the cut and raised piece 9 in the step form at the upstream side of the air current flow to thereby lower its heat transfer characteristic. Conversely, when the total length C″ of the fin base plate portion 5 in the air flowing direction is long, a ratio of the total length C″ in the air flowing direction of the cut and raised piece 9 in the step form occupying the total length A″ of the plate fin in the flow path direction of the air current becomes low with the consequence that the effect to be derived from the cut and raised piece 9 in the step form becomes attenuated as a whole.

Figure 32:
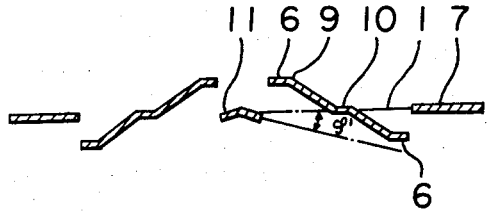
FIG. 32 is a cross-sectional view showing the fin base plate portion, in FIG. 29, which is bent in a substantially inverted V-shape.
Figure 33:
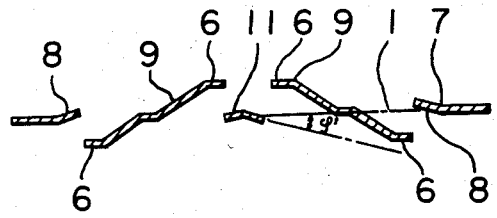
FIG. 33 is a cross-sectional view showing a state, wherein the end part of the fin base plate edge portion shown in FIG. 29 is bent at the side of the cut and raised piece.

In the following, explanations will be given as to the function of the heat exchanger according to the present invention, when the fin base plate portion 11 is bent in a substantially inverted V-shape and an angle $\phi''$ formed by one of the bent sides of the fin base plate portion and the fin base plate 1 is set to be in a range of from zero to 15°, as shown in FIG. 32. As in this embodiment, by setting the angle $\phi''$ formed between one side of the fin base plate portion 11 bent in a substantially inverted V-shape and the fin base plate 1 to be in a range of form zero to 15°, the temperature boundary layer to be generated at the fin base plate portion 11 per se which is situated at an intermediate position in the sinuous flow paths formed by the cut and raised pieces 9, 9 in the step form provided at both upstream side and the downstream side of the air flowing direction is disturbed to thereby improve the local heat transfer rate, as is the case with the afore-described first and second embodimetns, and, at the same time, since the fin base plate portion 11 is bent in a substantially inverted V-shape, the mechanical strength of the plate fins as a whole is also increased. In addition, at the time of machining the plate fin, it can be readily separated from the shaping mold, hence the effect to be derived from the shape of the fin base plate portion is remarkable in the workability of it.

In the following, explanations will be given as to the function of the heat exchanger according to the present invention, when the length B″ in the flowing direction of the air current of the fin base plate edge portions 7, 7 at both upstream and downstream sides, each extending from the fin end part to the edge of the cut and raised piece 9 in the step form, is set to be in a range of from 1.5 to 4.0 mm. It is seen that, when the length B″ in the flowing direction of the air current of the fin base plate edge portion 7 extending from the fin end part ot the edge of the cut and raised piece 9 in the step form is set to be in a range of from 1.5 to 4.0 mm, a ratio $\alpha/\Delta P$ between the heat transfer rate $\alpha$ outside the tube and the wind pressure loss $\Delta P$ becomes maximum in that range at the same wind velocity, as is the case with the afore-described first and second embodimetns shown in FIG. 18.

The reason for this is considered as follows. That is to say, when the length B″ in the flowing direction of the air current of the fin base plate edge portion 7 extending from the fin end part to the edge of the cut and raised piece 9 in the step form becomes long, the temperature boundary layer at this fin base plate edge portion 7 is developed and the heat transfer characteristic becomes lowered. On the contrary, when the length B″ in the flowing direction of the air current of the fin base plate edge portion 7 extending from the fin end part to the edge of the cut and raised piece 9 in the step form becomes short, there take place such disadvantages that, if the heat exchanger constructed with the plate fins is used as an evaporator, moisture content in the air which has been condensed on the surface of the plate fins scatters out of the air conditioning apparatus to the inconvenience of the user, or the plate fins cannot maintain their required mechanical strength to become broken during their assembly as the heat exchanger.

In the following, explanations will be given as to the function of the heat exchanger of the present invention, when the length G′ in the air flowing direction of the flat surface 10, which is in parallel with the air flowing direction and positioned in the middle of the cut and raised piece 9 in the step form, is set to be in a range of from 0.6 to 1.5 mm. It is seen that, when the length G' in the flowing direction of the air current of the flat surface 10, which is in parallel with the air flowing direction and positioned in the middle of the cut and raised piece 9 in the step form, is set to be in a range of from 0.6 to 1.5 mm, a ratio $\alpha/\Delta P$ between the heat transfer rate $\alpha$ outside the tube and the wind pressure loss $\Delta P$ becomes maximum in that specific range at the same wind velocity, as is the case with the aforedescribed second embodiment shown in FIG. 24.

The reason for this is considered as follows. That is to say, when the length G' in the air flowing direction of the air current of the flat surface 10, which is in parallel with the air flowing direction and positioned in the middle of the cut and raised piece 9 in the step form, is short, the effect of promoting the heat transfer effect due to the repeating sinuous flow paths for the air current to be formed by the cut and raised pieces 9, 9 in the mutually juxtaposed plate fins becomes reduced. On the contrary, when the length G' in the flowing direction of the air current of the flat surface 10, which is in parallel with the air flowing direction hand positioned in the middle of the cut and raised piece 9 in the step form, is long, there takes place splitting of the air current at the edge portions 6, 6 on both sides of the cut and raised piece 9, which splitting is liable to increase the wind pressure loss.

The curving effect of the air current can be further increased by bending the end part 8 of the fin base plate edge portion 7 at the side of the cut and raised piece 9 in the step form, the edge portion extending from the fin end part to the edge of the cut and raised piece 9 in the step form.

Furthermore, since the mutually adjacent cut and raised pieces 9 in the step form are provided in mutually opposite directions in a manner to be symmetrical with respect to the fin base palte portion 11, there can be eliminated various points of problem such as twising of the plate fin as a whole to occur at the time of its machining, and others, as has been experienced in the conventional heat exchanger.

Although, in the foregoing, the present invention has been described with particular reference to the preferred embodiments thereof, it should be noted that they are merely illustrative and not so restrictive, and that any changes and modifications may be made by those persons skilled in the art within the spirit and scope of the present invention as recited in the appended claims.

What is claimed is:

1. A plate-fin-tube type heat exchanger comprising:

a plurality of parallel plate fins stacked one upon the other;

a plurality of heat exchange fluid transmitting tubes passing through said plate fins and being supported thereby for exchanging heat between said heat transfer fluid and air flowing in an air flow direction between said plate fins;

at least one pair of louvers substantially aligned in said air flow direction and positioned between said tubes in each said plate fin, each louver of said at least one pair of louvers traversing a plane of said plate fin and having a leading edge and a trailing edge extending transverse to said air flow direction, wherein louvers of each said pair are spaced from one another in said airflow direction by a distance such that a cut in said fin plate for a trailing edge of a first louver of said pair of louvers is spaced upstream from a cut in said fin plate for leading edge of a second of said louvers of said pair of louvers by a distance C'', and wherein a central portion of each of said louvers in said airflow direction is angled by a lifting angle with respect to said plane of said plate fin and both leading and trailing ends of each said louver are bent to extend substantially parallel with said plate fin plane but are spaced therefrom by a distance E'' on opposite sides of said plate fin plane; and a portion of said fin plate positioned between said cut for said trailing edge of said first louver and said cut for said leading edge of said second louver comprising a continuous piece having two halves in said air flow direction, said halves of said portion being angle with respect to said plate fin plane with the same sense as that of the lifting angle of an adjacent said louver, and passing through said plate fin plane.

2. The heat exchanger according to claim 1 wherein the total length in said air flow direction of each said louver is F''; the total length of the plate fin in the air flow direction is A''; the number of rows of a group of heat transmitting tubes spaced in a direction orthogonally intersecting with the air flow direction is NR; an angle of inclination which is formed by a straight line connecting the leading and trailing edge portions of each said louver is $\theta''$; an angle of inclination of said fin base plate portion with respect to the fin base plate plane is $\phi'$; and the length in the airflow direction between a cut for a trailing edge of a downstream louver and a downstream edge of said plate fin is B'', wherein the length F'' is set to be in a range of from 4.0 to 6.0 mm.

3. The heat exchanger according to claim 2 wherein a relational equation F''/(A''/NR'') is set to be from 0.15 to 0.4.

4. The heat exchanger according to claim 2 wherein the angle $\theta''$ is set to be in a range of from 18° to 34°.

5. The heat exchanger according to claim 2 wherein the length C'' is set to be in a range of from 1.5 to 4.0 mm, and a ratio C''/F'' is set to be in a range of from 0.4 to 0.8.

6. The heat exchanger to claim 2 wherein the length B'' is set to be in a range of from 1.5 to 4.0 mm.

7. The heat exchanger according to claim 2 wherein the angle $\phi'$ is set to be in a range of from zero to 15°.

8. The heat exchanger according to claim 2, wherein a relational equation F''(A''/NR'') is set from 0.15 to 0.4.

9. The heat exchanger according to claim 2 wherein the angle $\theta''$ is set to be in a range from 18° to 34°.

10. The heat exchanger according to claim 2 wherein the length C'' is set to be in a range of from 1.5 to 4.0 mm, and that a ratio C''/F'' is set to be in a range of from 0.4 to 0.8.

11. The heat exchanger according to claim 2 wherein the length B'' is set to be in a range of from 1.5 to 4.0 mm.

12. The heat exchanger according to claim 2 wherein the length G'' is set to be in a range of from 0.6 to 1.5 mm.

13. The heat exchanger according to claim 2 wherein said angle $\phi'$ is set to be in a range of from zero to 15°.

14. The heat exchanger of claim 1 wherein said lifting angle of said first louver is opposite said lifting angle of said second louver and wherein said portion of said fin plate is angle with respect to said plate fin plane in such a way as to form a substantially inverted V-shape.

15. The heat exchanger of claim 14 wherein said central portion of each said louver has a step portion extending parallel and coplanar to said plate fin plane, said step having a length G' in said airflow direction.

* * * * *